US008778666B1

(12) United States Patent
Chung et al.

(10) Patent No.: US 8,778,666 B1
(45) Date of Patent: Jul. 15, 2014

(54) DEVICES, APPARATUS, AND METHODS EMPLOYING BIOMIMETIC CILIA FOR MICROFLUIDIC MANIPULATION

(75) Inventors: Jae Chung, Bellevue, WA (US); Santosh Devasia, Lake Forest Park, WA (US); James J. Riley, Seattle, WA (US); Kieseok Oh, Seattle, WA (US); Kyong Hoon Lee, Redmond, WA (US); Jiradech Kongthon, Seattle, WA (US)

(73) Assignee: University of Washington, Seattle, WA (US)

( * ) Notice: Subject to any disclaimer, the term of this patent is extended or adjusted under 35 U.S.C. 154(b) by 551 days.

(21) Appl. No.: 12/607,029

(22) Filed: Oct. 27, 2009

Related U.S. Application Data

(60) Provisional application No. 61/108,801, filed on Oct. 27, 2008.

(51) Int. Cl.
*B01F 13/00* (2006.01)
*B01L 3/00* (2006.01)

(52) U.S. Cl.
CPC ..... *B01F 13/0091* (2013.01); *B01F 13/0059* (2013.01); *B01F 13/0064* (2013.01); *B01L 3/502707* (2013.01); *B01L 3/50273* (2013.01); *B01L 3/502746* (2013.01); *B01L 2400/0484* (2013.01); *B01L 2400/043* (2013.01); *B01L 2400/0415* (2013.01); *B01L 2400/0433* (2013.01)
USPC ..... 435/287.3; 435/287.1; 435/287.2; 435/288.3

(58) Field of Classification Search
CPC ..... B01F 13/0091; B01F 13/0059; B01F 13/0064; B01L 3/502707; B01L 3/50273; B01L 3/502746; B01L 2400/043; B01L 2400/0415; B01L 2400/0433; B01L 2400/0484
USPC ..... 435/287.1, 287.2, 287.3, 288.3
See application file for complete search history.

(56) References Cited

U.S. PATENT DOCUMENTS

| | | | | |
|---|---|---|---|---|
| 2004/0021185 | A1* | 2/2004 | Oberhardt et al. | 257/414 |
| 2005/0202504 | A1* | 9/2005 | Anderson et al. | 435/6 |
| 2006/0069425 | A1* | 3/2006 | Hillis et al. | 623/1.16 |
| 2009/0165877 | A1* | 7/2009 | Den Toonder et al. | 137/831 |

FOREIGN PATENT DOCUMENTS

WO WO-2008/110975 A1 * 9/2008

OTHER PUBLICATIONS

Yeo, et al., "Hybrid Fiber Fabrication Using an AC Electric Field and Capillary Action", Proceedings of IMECE, ASME International Mechanical Engineering Congress and Exposition, IMECE 2007-42305, Seattle, Washington, USA, Nov. 11-15, 2007.
J. Chung, K.-H. Lee, J. Lee, and R. S. Ruoff, "Toward Large Scale Integration of Carbon Nanotubes," Langmuir 20, 3011-3017, 2004.
Oh, et al., "Fluid Manipulation by Bio-mimetic Cilia," Proceedings of IMECE, 2007 ASME International Mechanical Engineering Congress and Exposition, IMECE 2007-42376, Seattle, Washington, USA, Nov. 11-15, 2007.

* cited by examiner

*Primary Examiner* — Nathan Bowers
(74) *Attorney, Agent, or Firm* — McDonnell Boehnen Hulbert & Berghoff LLP

(57) ABSTRACT

A device comprises: one or more cantilevered biomimetic cilia, and a liquid disposed among the one or more biomimetic cilia, wherein individual biomimetic cilia are at least partially submerged in the liquid, and wherein the biomimetic cilia are arranged for excitation into resonance, such as for mixing and pumping via the resonant behavior of the excited cilia.

19 Claims, 29 Drawing Sheets

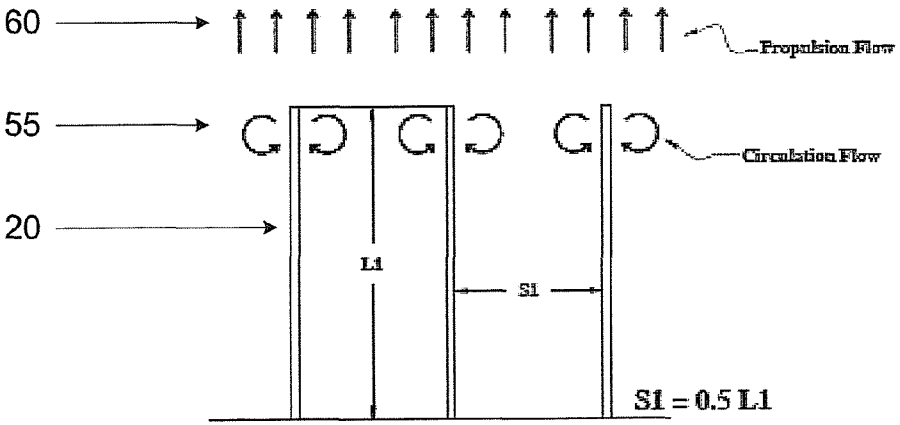
Fig. 4A
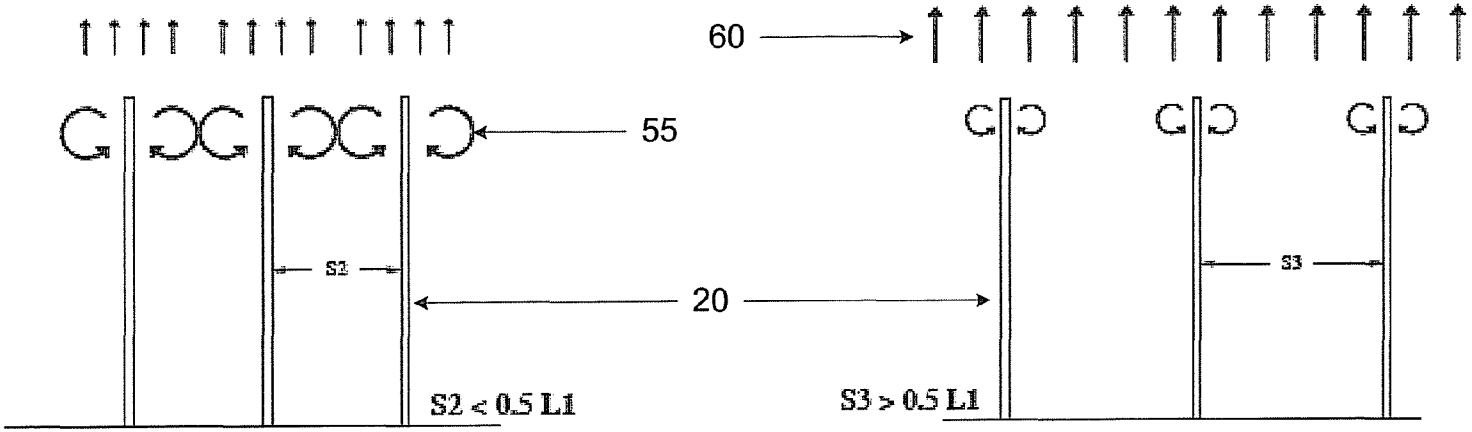
Fig. 4C
Fig. 4B

Fig. 10C
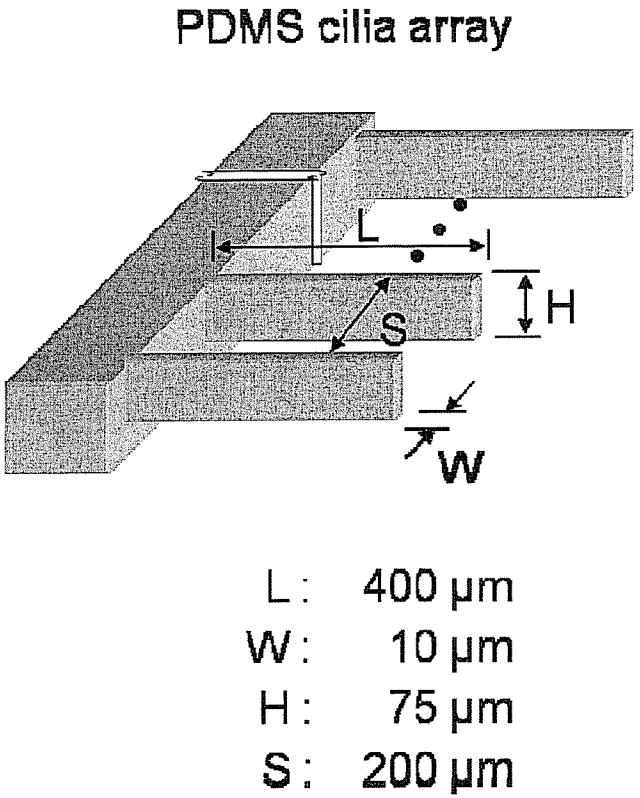
Fig. 10A
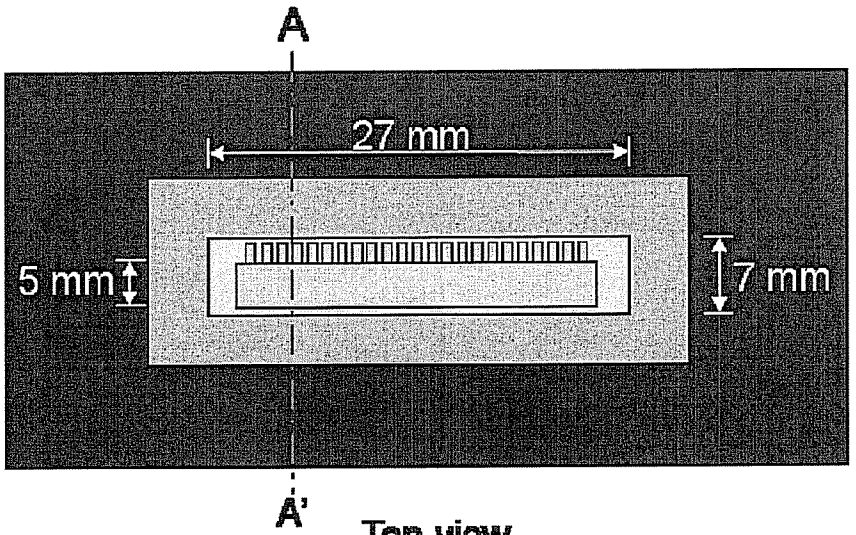
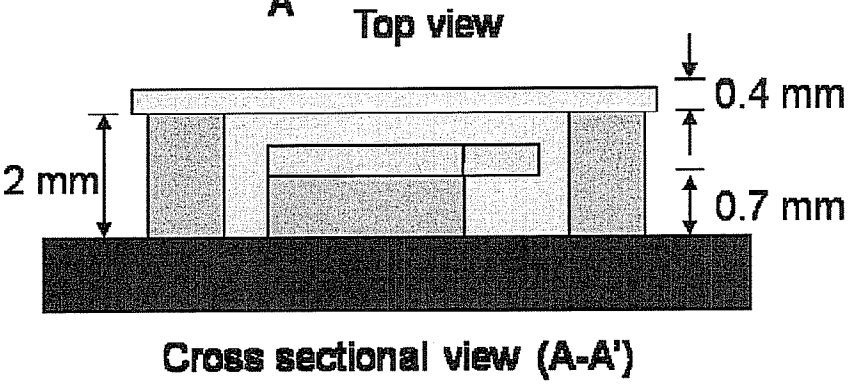
Fig. 10B (a)

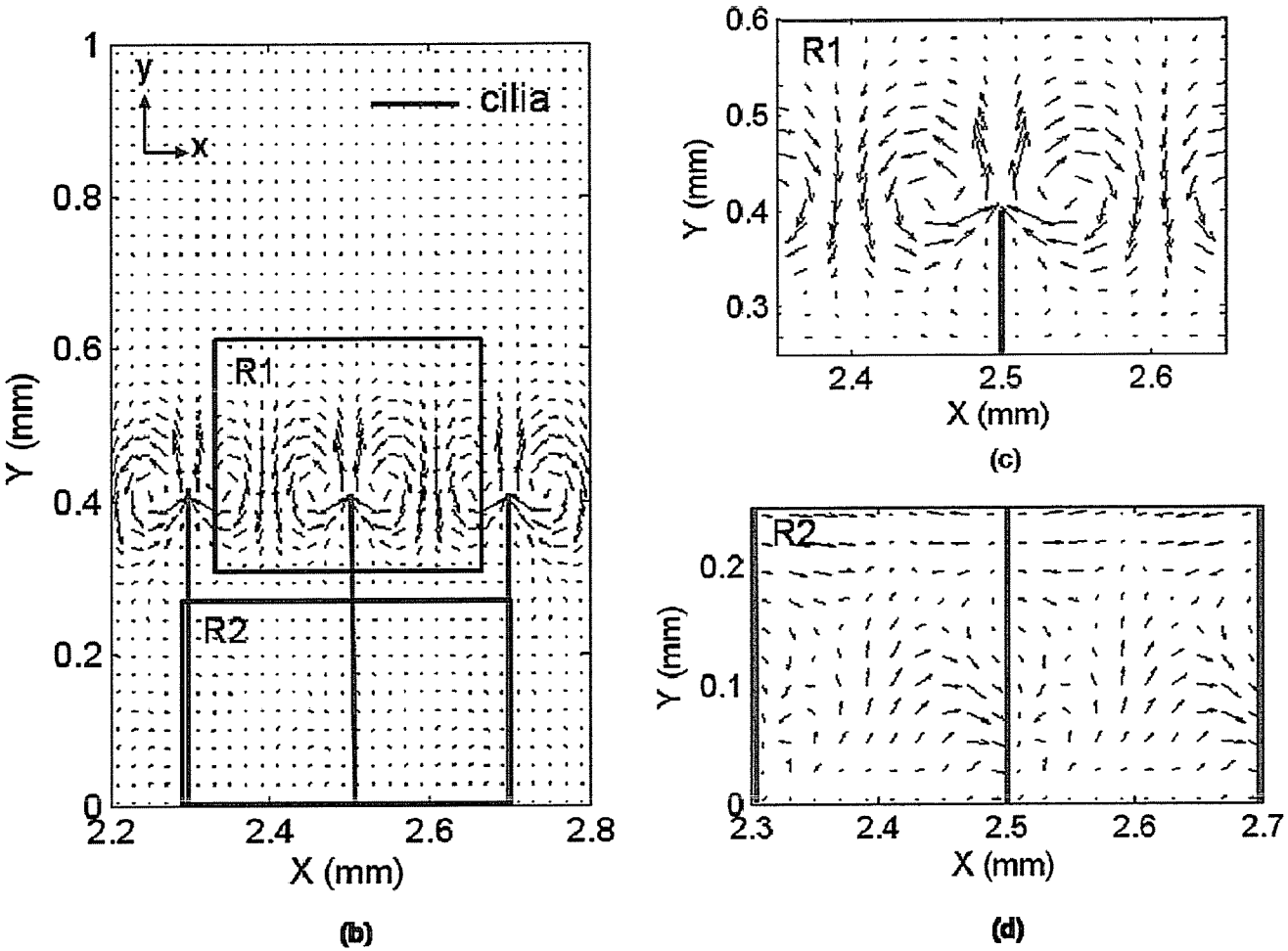
Figs. 15B-D

DEVICES, APPARATUS, AND METHODS EMPLOYING BIOMIMETIC CILIA FOR MICROFLUIDIC MANIPULATION

PRIORITY CLAIM

This application claims priority to Provisional Application Ser. No. 61/108,801 filed Oct. 27, 2008 the disclosure of which is expressly incorporated herein by reference.

GOVERNMENT RIGHTS

The United States government may have certain rights in this invention pursuant to Government Grant #CMMI0624597 with the National Science Foundation.

BACKGROUND OF THE INVENTION

Fluid manipulation at the microscale is very important for biomolecule mixing and drug delivery. In nature, the rhythmic beating of biological cilia can provide motility for cells and microorganisms. For example, the movement of cilia transports fluids and particles in biological ducts. The motion of biological cilia can be an effective and safe method for biomolecule handling, especially in a microscale environment where the Reynolds number is low. To date, various approaches have attempted to mimic naturally-occurring, biological cilia, none of which have proved satisfactory.

FIGURES

FIG. 4A-4C are views of the specified fluid flow patterns that are achieved based on the spacing of the cilia from one another.

FIG. 4A is a side view of the biomimetic cilia spaced apart (S1) by a distance equal to half of the length of each cilium such that neither mixing nor pumping fluid flow patterns dominate.

FIG. 4B is a side view of the biomimetic cilia spaced apart (S2) by a distance that is less than half of the length of each cilium such that a mixing fluid flow pattern dominates.

FIG. 4C is a side view of the biomimetic cilia spaced apart (S3) by a distance that is greater than half of the length of each cilium such that a pumping fluid flow pattern dominates FIGS. 5-8 provide an overview of manufacturing methods.

FIG. 10A is a top view of the device submerged in water.

FIG. 10B is a side view of the device submerged in water.

FIG. 10C a perspective view of the biomimetic cilia.

Figure 11:
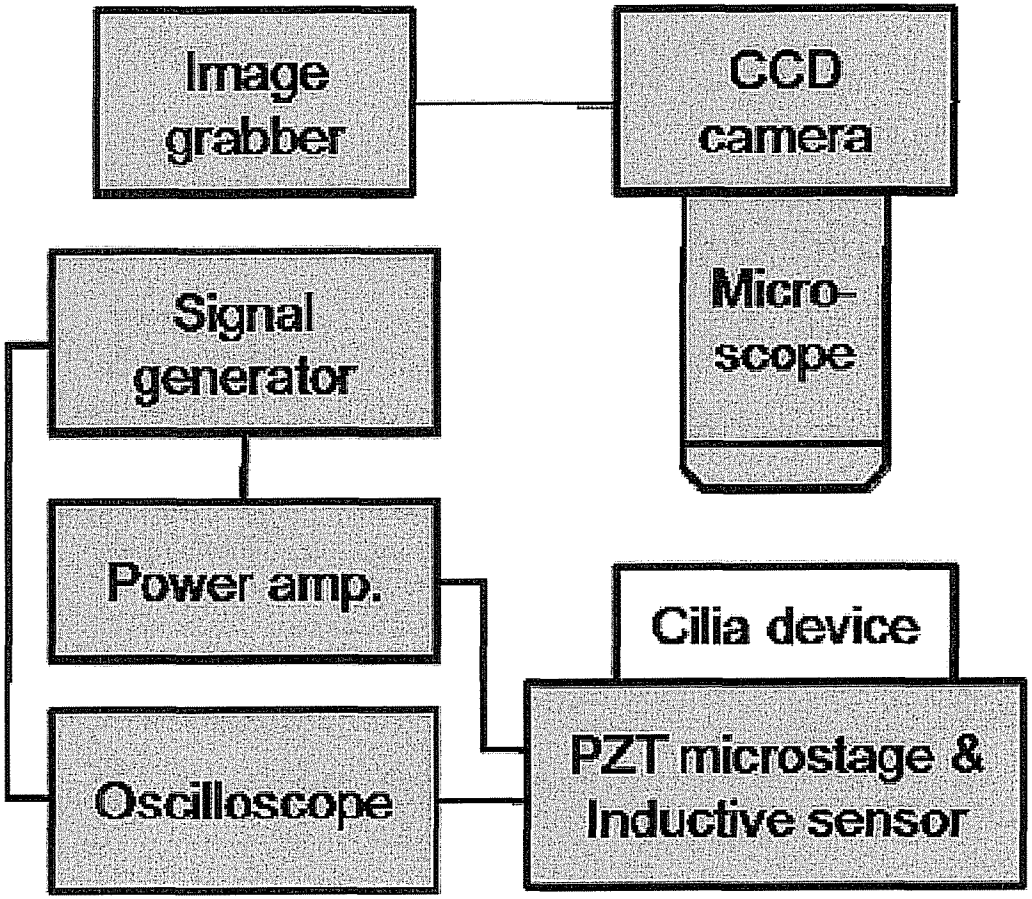

FIG. 11 is a schematic view of the experimental set-up to excite biomimetic cilia, measure the cilia response, and trace the microfluid motion.

FIGS. 12A-F illustrate the fabrication of a mold and the biomimetic cilia device.

Figure 12:
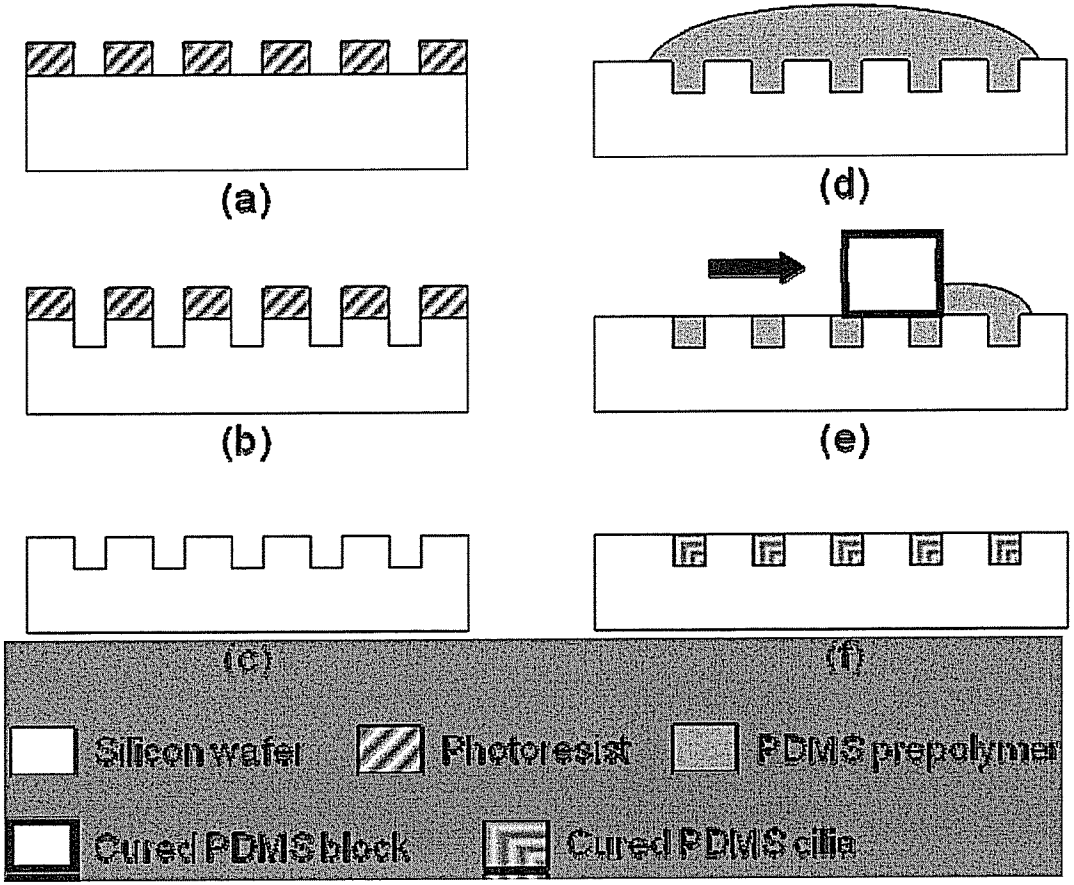

FIG. 12A is a side view of patterning a photoresist layer on a silicon wafer to create a mold.

FIG. 12B is a side view of deep reactive ion etching on a silicon wafer to create a mold.

FIG. 12C is a side view of dessicating to form a monolayer formed on a silicon wafer to create a mold.

FIG. 12D is a side view of pouring a mixture on a mold.

FIG. 12E is a side view of scraping the excess mixture from a mold.

FIG. 12F is a side view of a cured mixture still in a mold.

FIGS. 13A-F illustrate wet release fabrication of the biomimetic cilia device.

FIG. 13A is a side view of a cured biomimetic cilia device in a Si mold and microfluidic apparatus components.

FIG. 13B is a side view of microfluidic apparatus components after a stamp-and-stick bonding process.

FIG. 13C is a side view of the wet-release of the cured biomimetic cilia device and transfer to the microfluidic apparatus.

FIG. 13D is a side view of the assembled microfluidic device with biomimetic cilia after being removed from the water.

FIG. 13E is a side view of the assembled microfluidic device with biomimetic cilia with a cover plate placed on the top of the device.

FIG. 13F is a perspective view of the assembled microfluidic device with biomimetic cilia with a cover plate placed on the top of the device.

Figure 14:
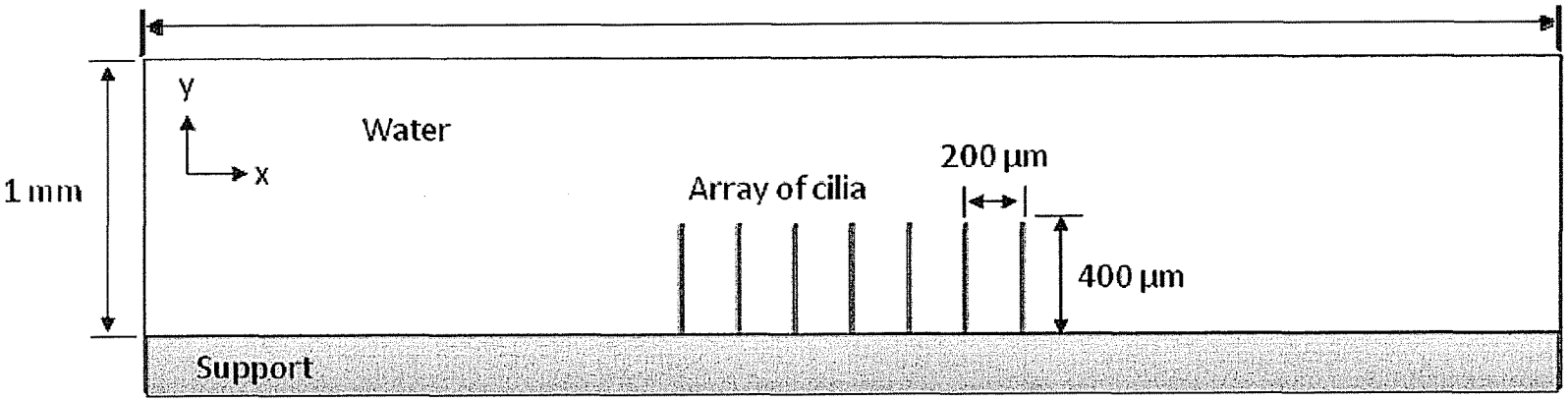

FIG. 14 is a side view of a simulation model.

FIG. 15A-D illustrate the velocity vectors of the fluid flow due to biomimetic cilia motion.

Figure 15A:
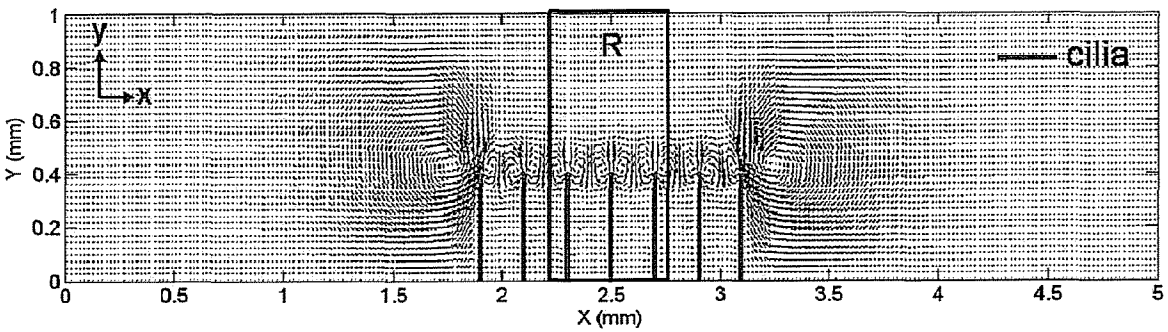

FIG. 15A shows velocity vectors for biomimetic cilia induced fluid flows at 65 Hz.

FIG. 15B identifies velocity vectors falling in regions R1 and R2 of the fluid flow induced by the biomimetic cilia.

FIG. 15C shows the velocity vectors in Region R1 for biomimetic cilia induced fluid flows at 65 Hz.

FIG. 15D shows the velocity vectors in Region R2 for biomimetic cilia induced fluid flows at 65 Hz.

Figure 16:
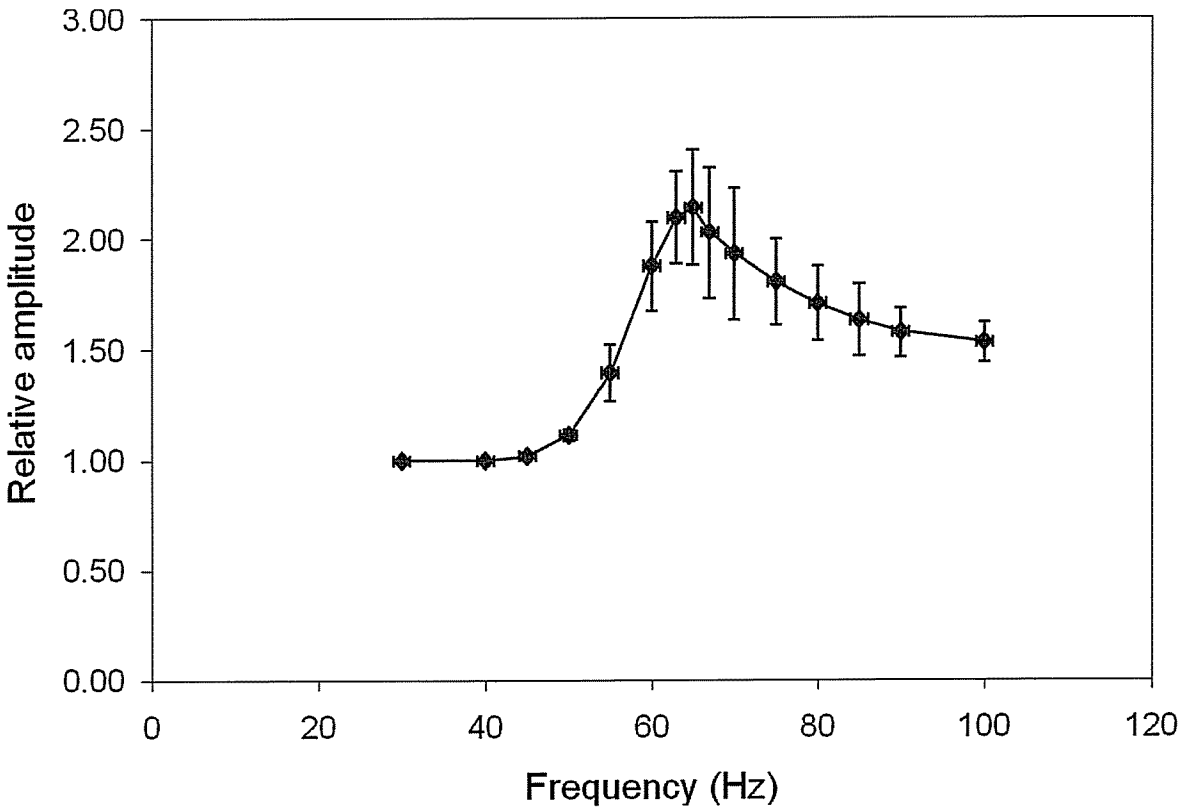

FIG. 16 shows the frequency response of the observed cilia motion.

Figure 17A:
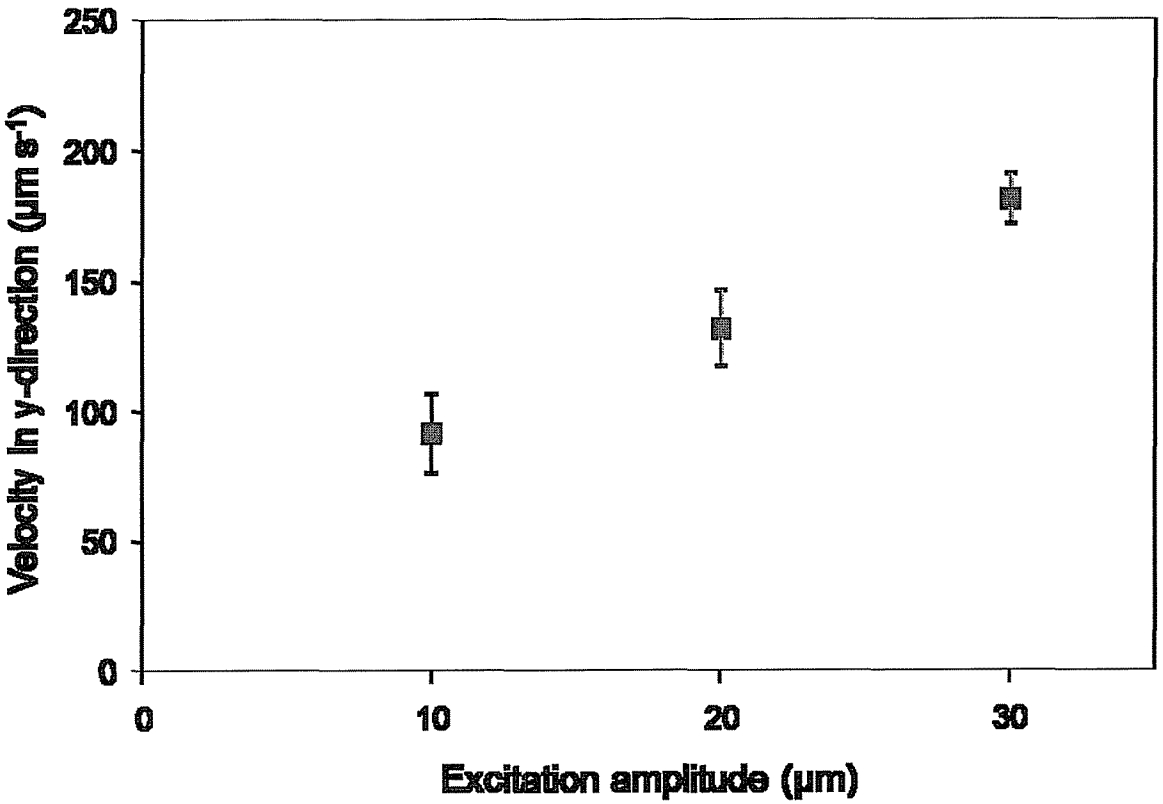

FIG. 17A shows the average velocities of microspheres at excitation amplitudes of 10, 20, and 30 μm.

Figure 17B:
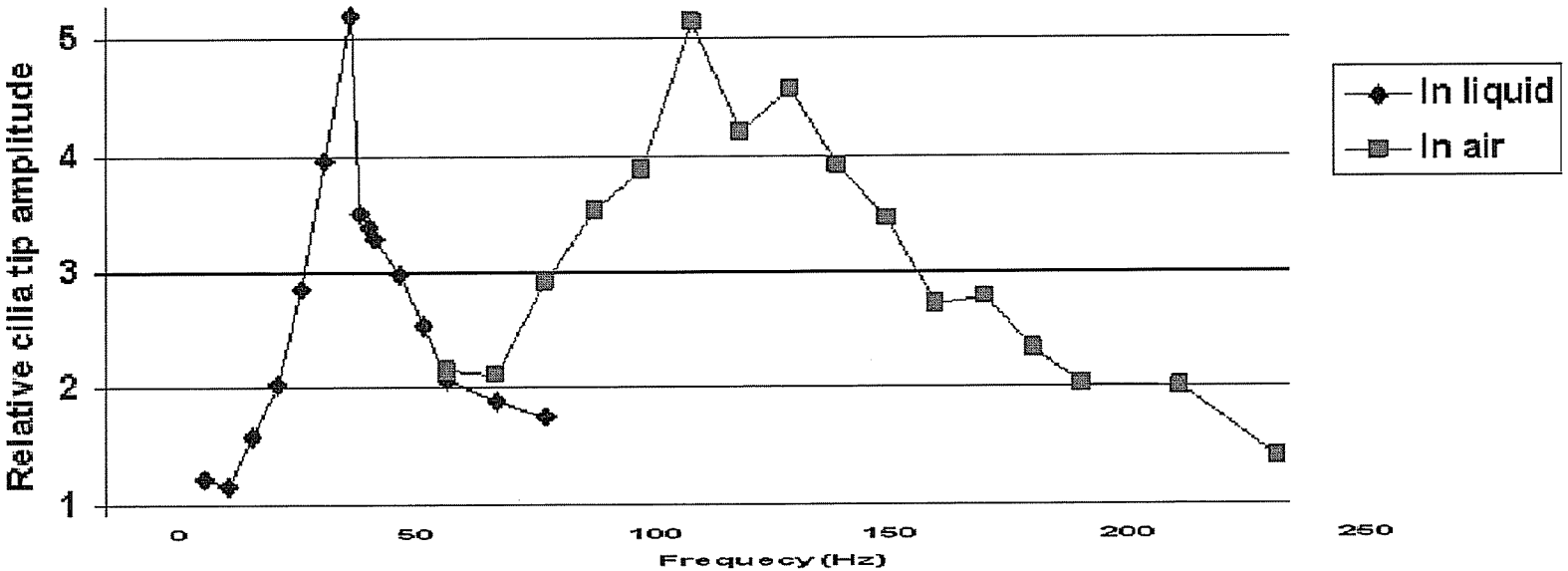

FIG. 17B shows relative cilia tip amplitudes to the frequency response of the cilia in air and in a solution.

Figure 18:
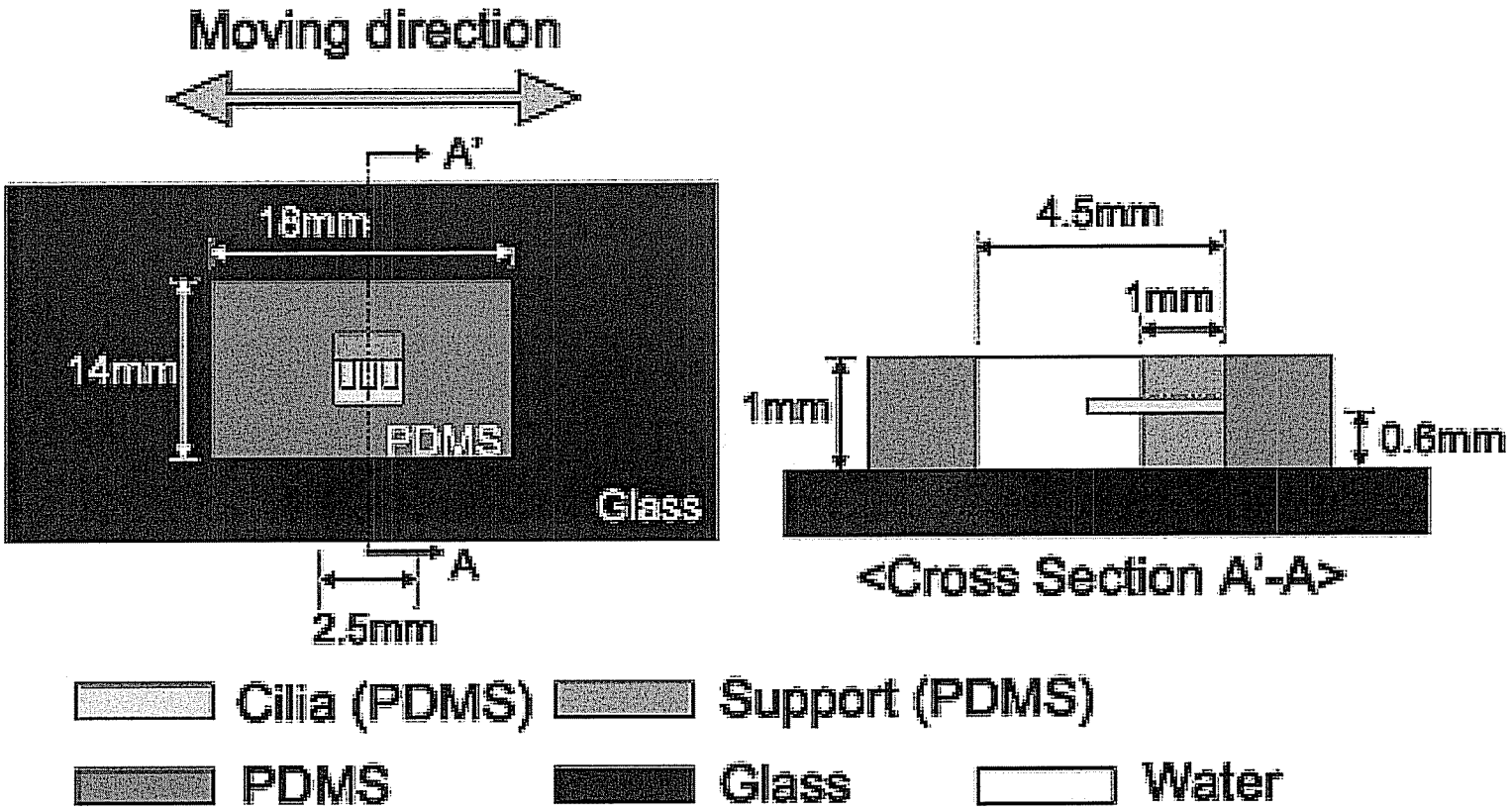

FIG. 18 shows a top view and a cross-sectional view of one embodiment of a microfluidic apparatus having three cilia.

Figure 19:
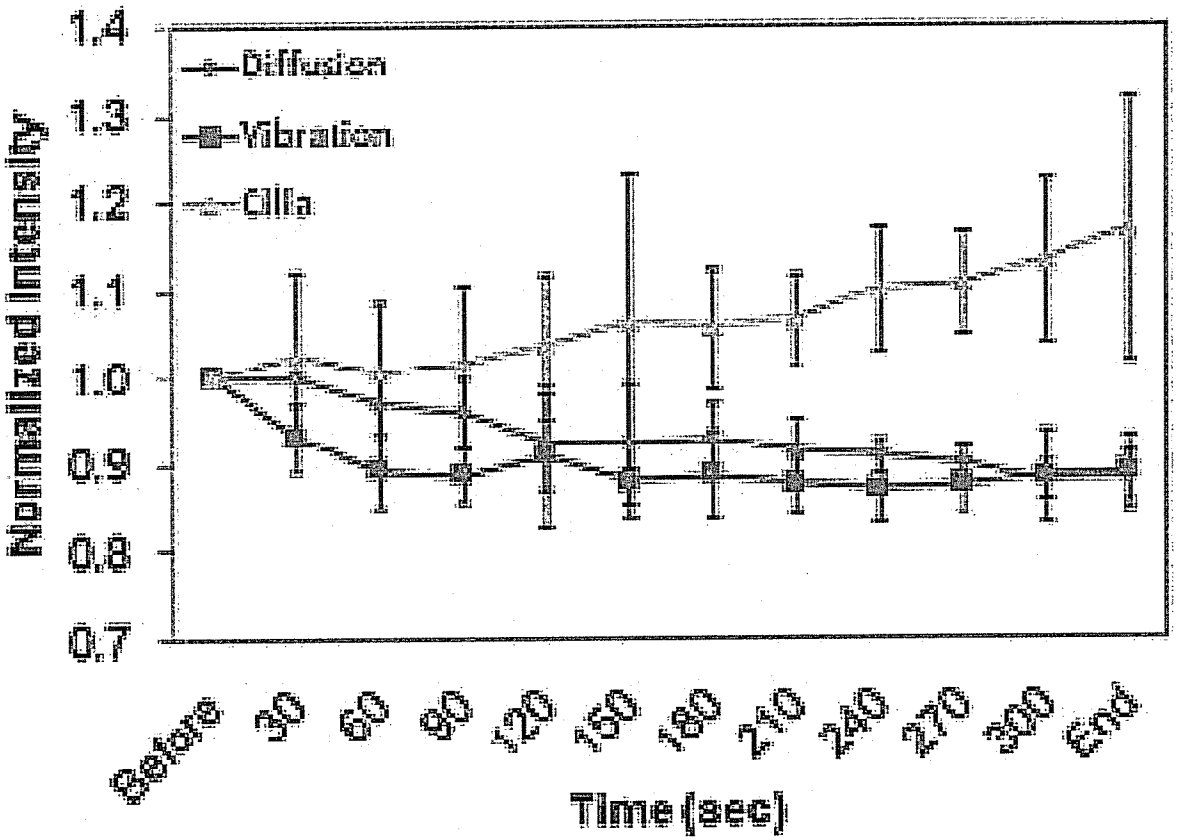

FIG. 19 shows mixing performance via diffusion, vibration without cilia, and cilia actuation.

Figure 20B:
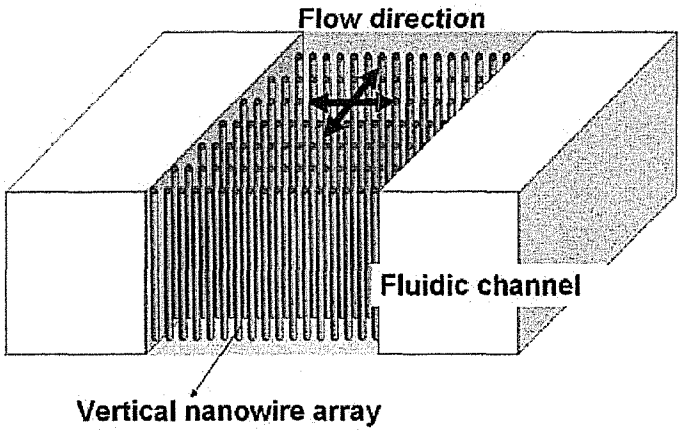
Figure 20A:
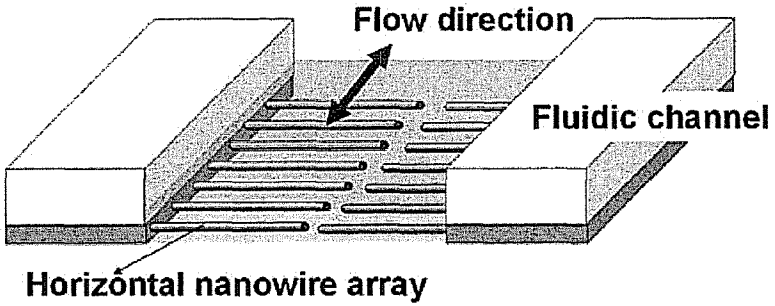

FIG. 20A is a perspective view of one-dimensional fluid transport using biomimetic cilia.

FIG. 20B is a perspective view of shows two-dimensional fluid transport using biomimetic cilia.

Figure 21B:
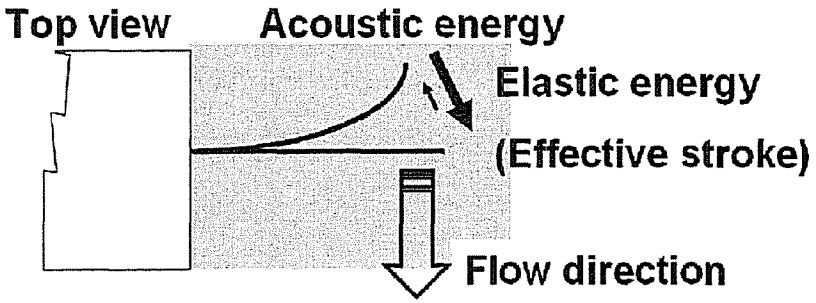
Figure 21A:
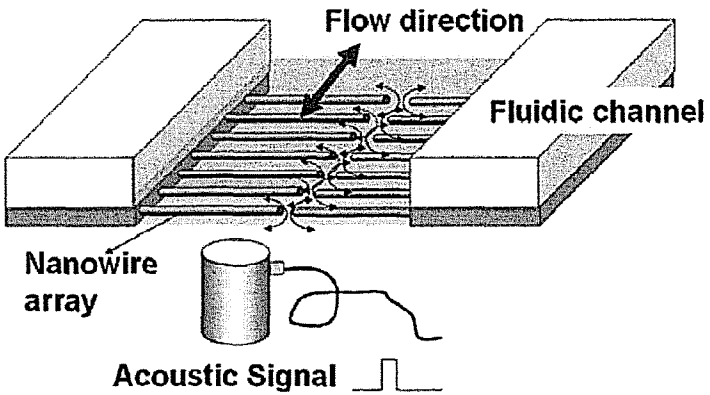

FIG. 21A is a perspective view of biomimetic cilia actuated by acoustic asymmetric pulses.

FIG. 21B is a side view of flow stroke and fast stroke movement.

FIGS. 22A-G illustrates a fabrication method of the biomimetic cilia device.

FIG. 22A is a side view of thermally growing an oxide layer on an Si wafer to fabricate an electric insulation layer and patterning the oxide layer to create a trench by a reactive ion etching (RIE).

FIG. 22B is a side view of depositing Cr/Au electrodes on the oxide layer for SiC cilia assembly.

FIG. 22C is a side view of aligning SiC cilia by an electric field guided assembly method on the electrodes.

FIG. 22D is a side view of depositing an additional metal layer (Al) on the SiC cilia to mechanically clamp the assembled SiC cilia.

FIG. 22E is a side view of spin-coating and patterning photoresist on the SiC assembled device.

FIG. 22F is a side view of performing RIE through the thin slit of the photoresist to etch the center region of the SiC cilia followed by removing the photoresist FIG. 22G is a side view of covering the assembled device with a mold.

Figure 23:
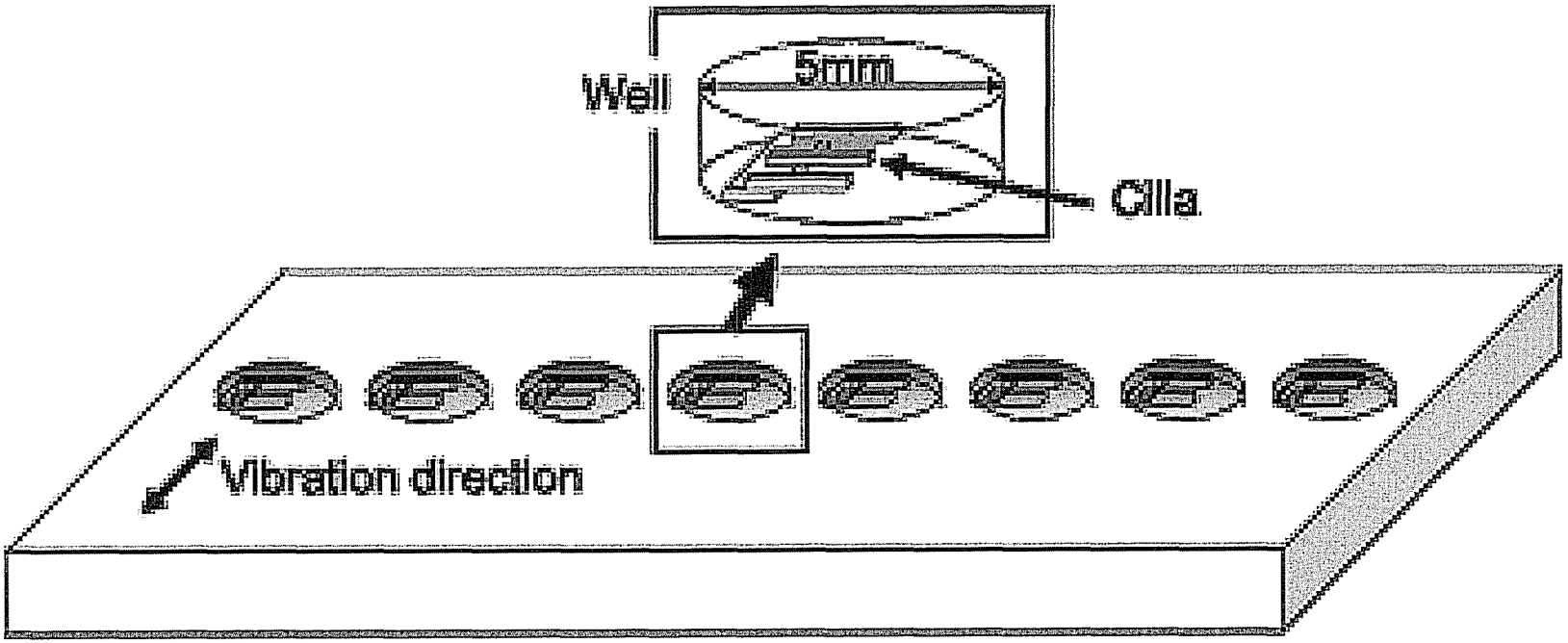

FIG. 23 is a perspective view of an 8×1 array device containing three cilia in each well.

Figure 24A:
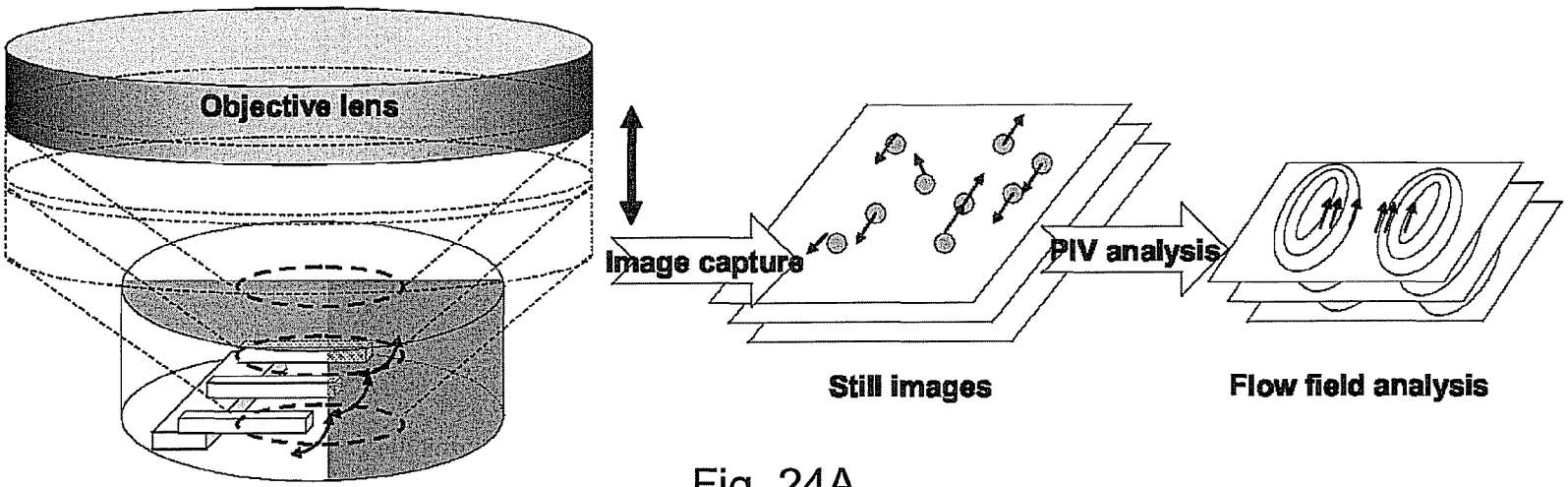

FIG. 24A is a schematic of the process to measure the motion of microspheres.

Figure 24B:
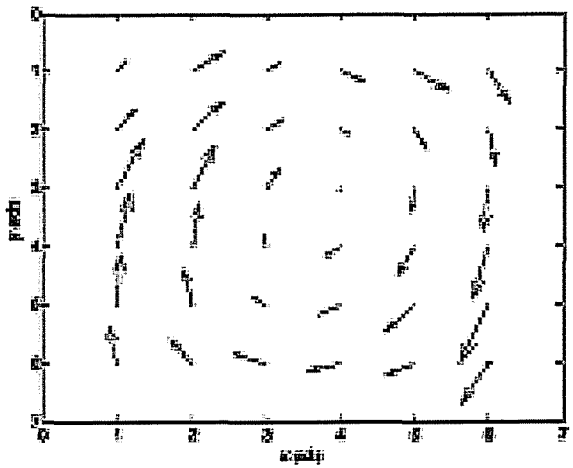

FIG. 24B shows the particle image velocimetry analysis for a convective flow.

Figure 25A:
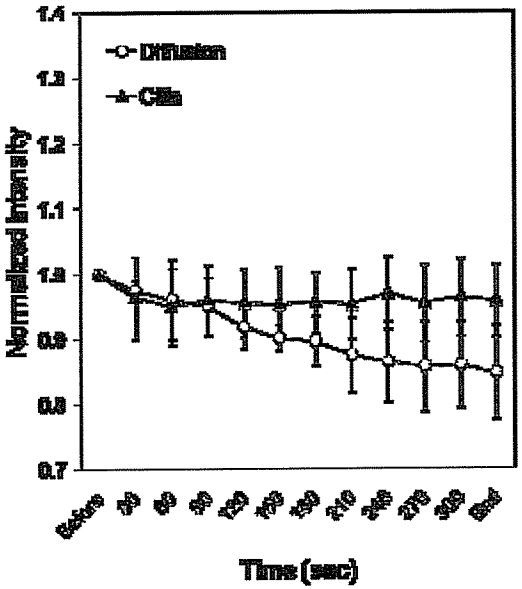

FIG. 25A shows experimental results for a negative control experiment not having biotin.

Figure 25B:
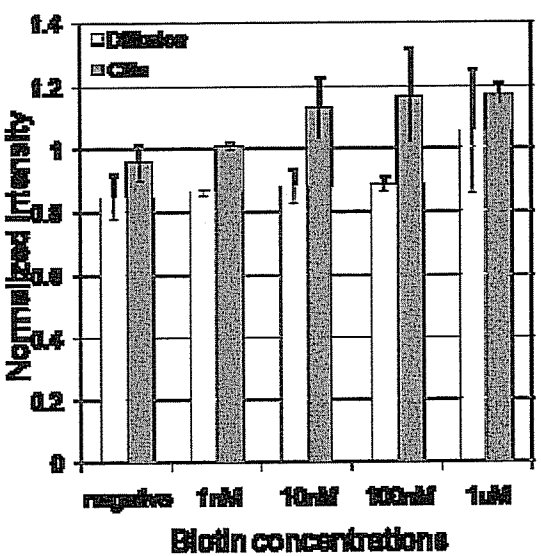

FIG. 25B shows a comparison of various biotin concentrations.

Figure 25C:
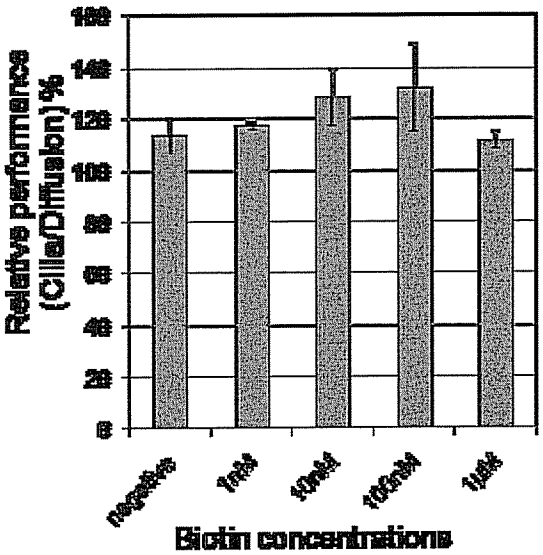

FIG. 25C shows the relative mixing efficiency of biomimetic cilia actuation to diffusion.

Figure 26:
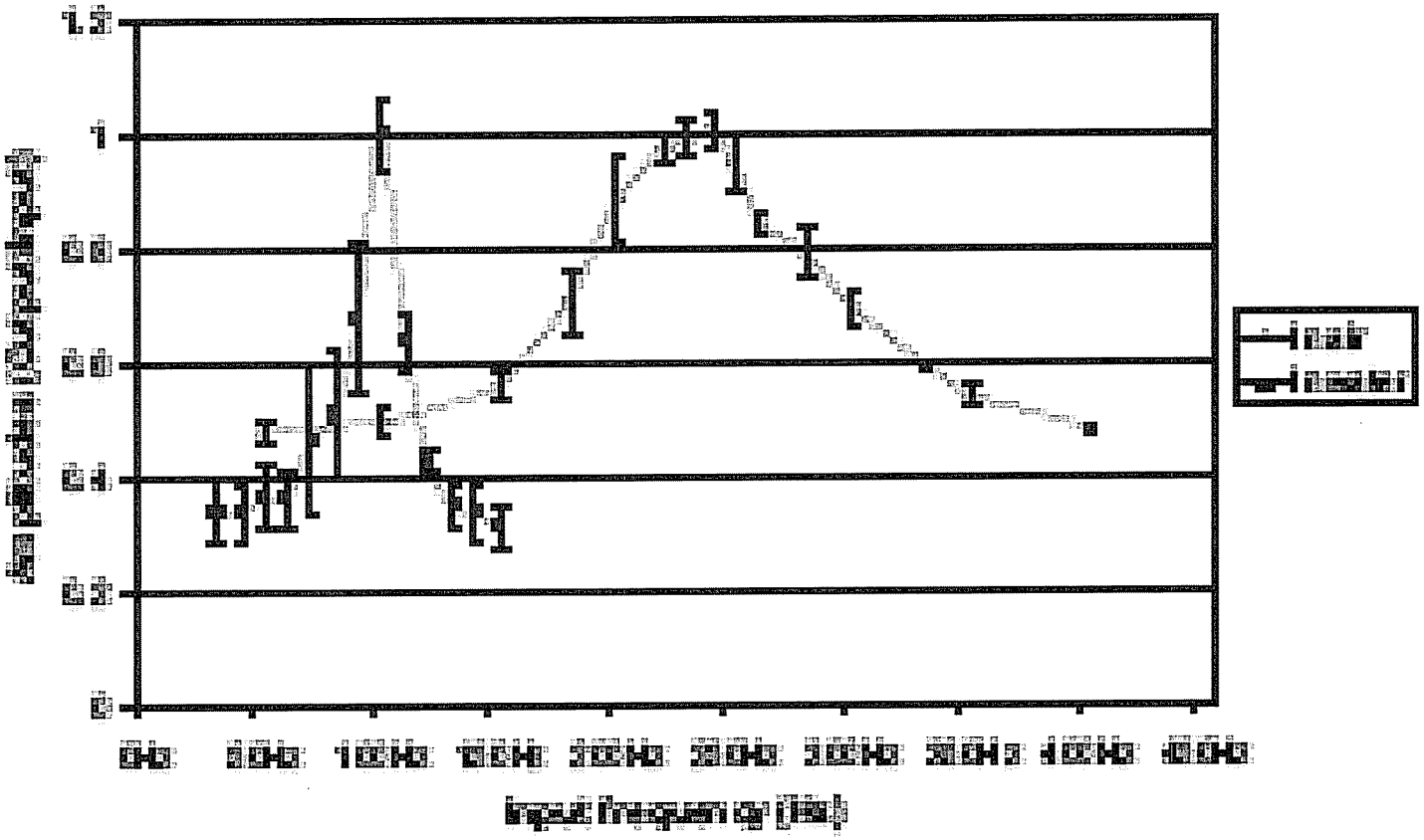

FIG. 26 shows the normalized frequency response of observed cilium motion based on relative tip amplitudes to the cilium base in air and in water.

Figure 27:
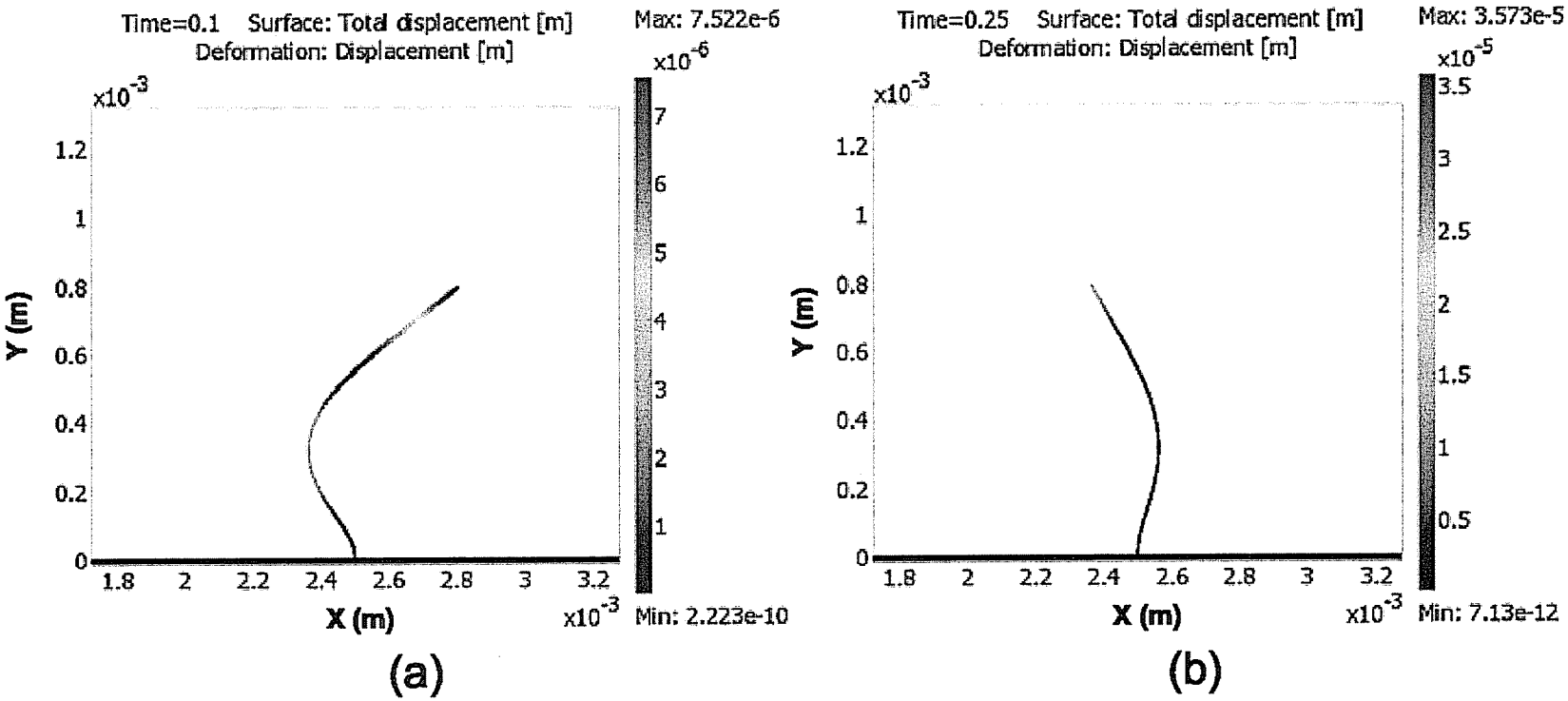

FIG. 27A shows the deformed shape of the cilium and displacement of the sphere at 0.1 sec.

Figure 28B:
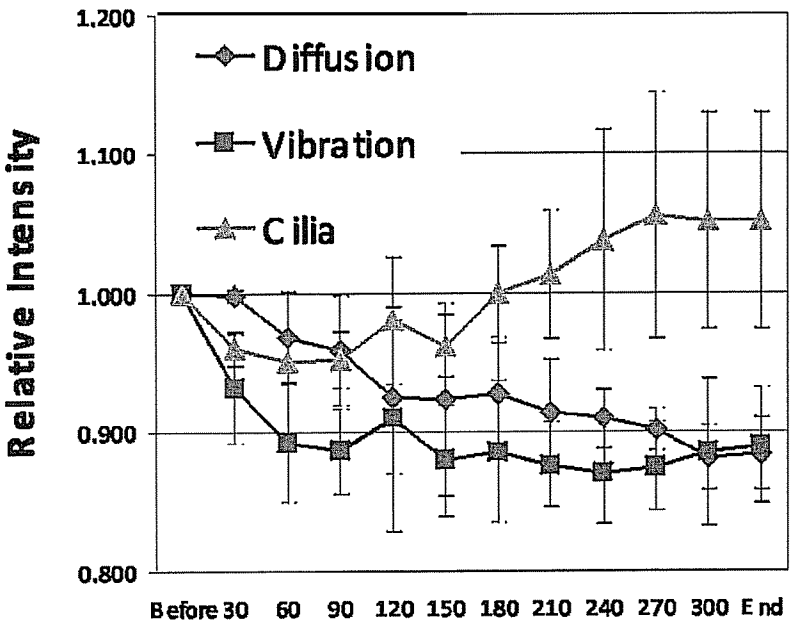
Figure 28A:
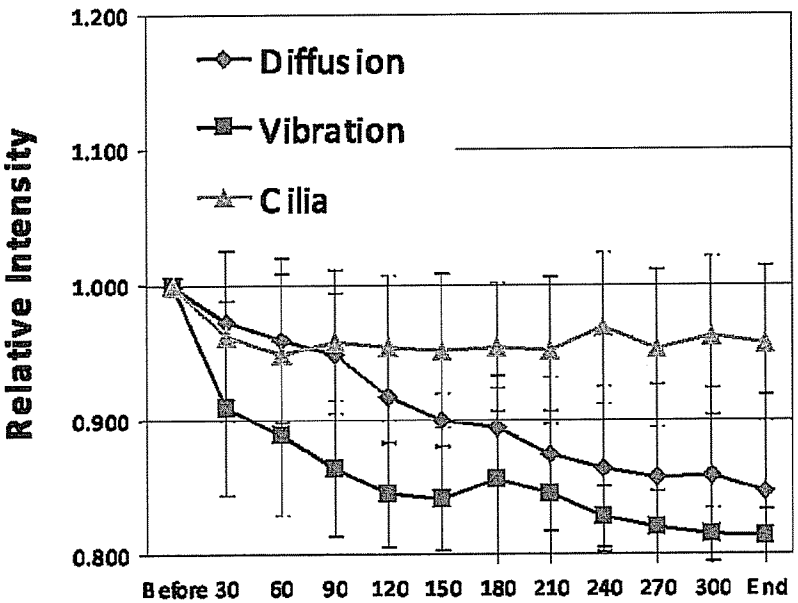

FIG. 27B shows the deformed shape of the cilium and displacement of the sphere at 0.25 sec FIG. 28A shows the relative intensity variation of negative control according to reaction time for diffusion, vibration without cilia, and vibration with cilia.

FIG. 28B shows the relative intensity variation for a 100 nM biotin reaction for diffusion, vibration without cilia, and vibration with cilia.

Figure 29:
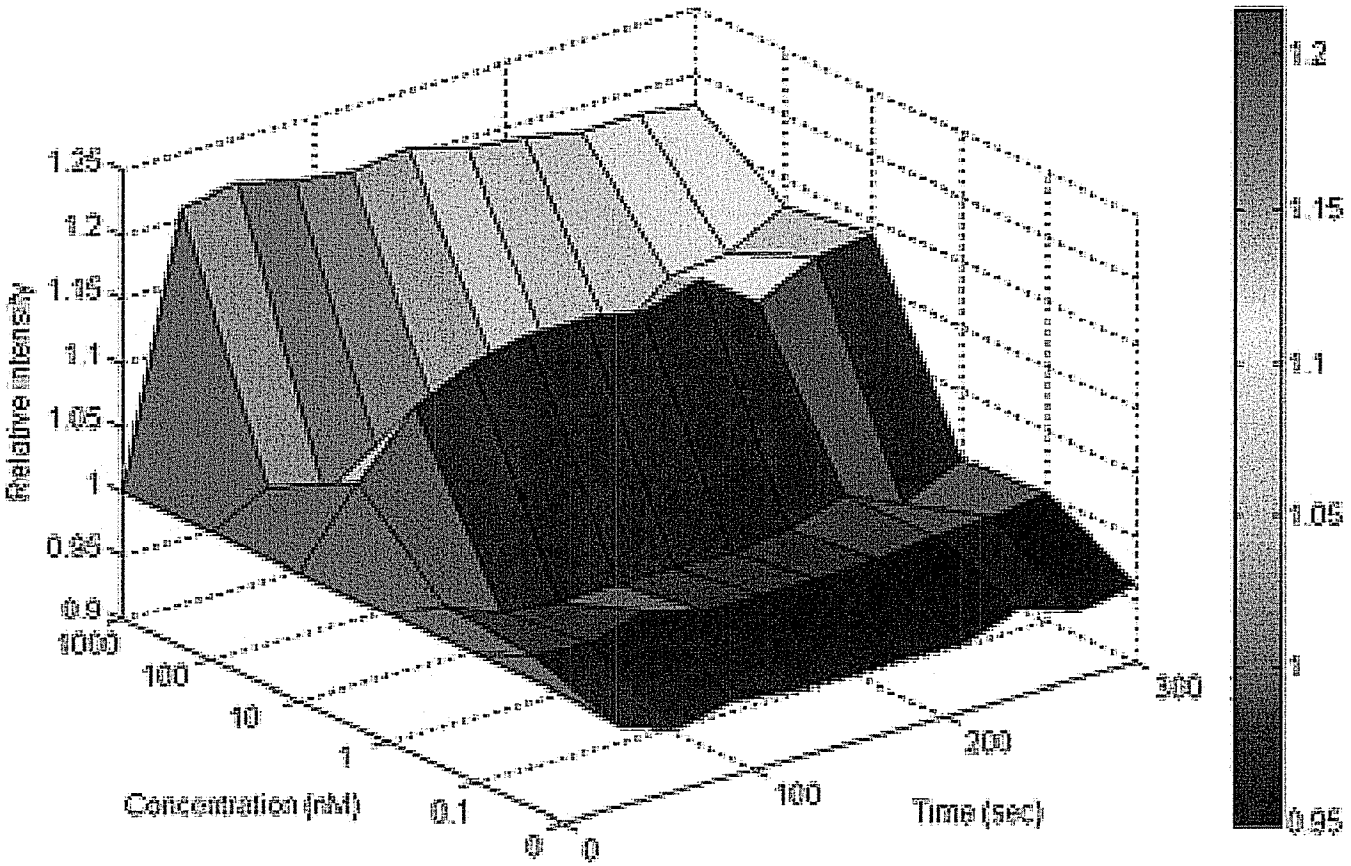

FIG. 29 shows the relative intensity variation for diffusion, vibration without cilia, and vibration with cilia according to various concentrations.

DETAILED DESCRIPTION

In a first aspect, a device comprises: one or more cantilevered biomimetic cilia. and a liquid disposed among the one or more biomimetic cilia, wherein individual biomimetic cilia are at least partially submerged in the liquid, and wherein the biomimetic cilia are arranged for excitation into resonance, such as for mixing and pumping via the resonant behavior of the excited cilia.

Figure 1B:
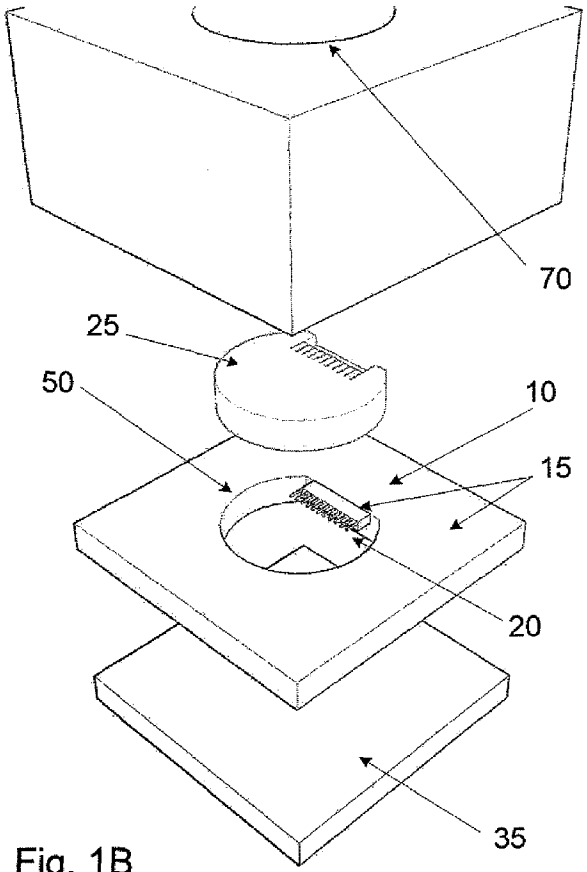
FIG. 1B is a perspective exploded view of a single micro-well of a microfluid apparatus.
Figure 1A:
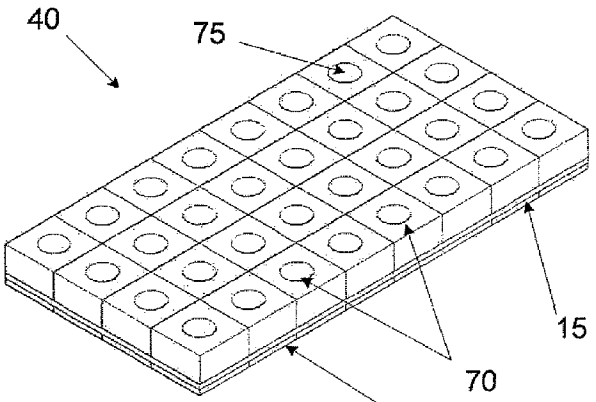
FIG. 1A is a perspective view of a microfluid apparatus with arrayed micro-wells.
Figure 1C:
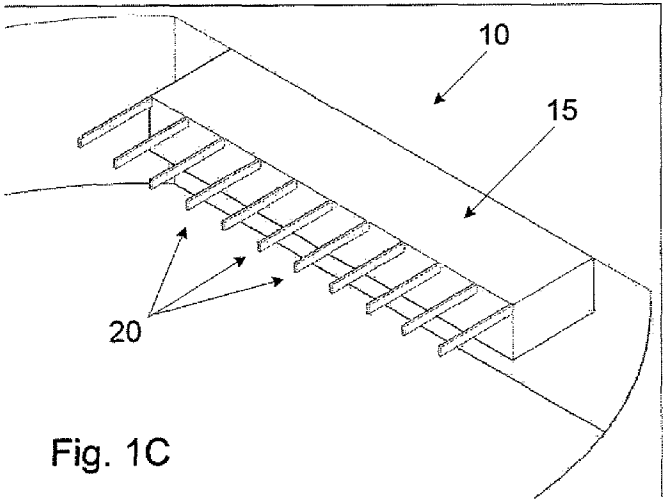
FIG. 1C is a perspective view of a biomimetic cilia and a backbone disposed in a fluid channel.

An example of this aspect is shown in FIG. 1B-C, showing the device 10, a backbone 15, one or more biomimetic cilia 20 (as shown "a plurality of biomimetic cilia) coupled to the backbone 15, wherein each biomimetic cilium has a length "L" that is at least 5 times greater than its width "W", and a liquid 25 disposed among the plurality of biomimetic cilia 20, wherein individual biomimetic cilia 20 are at least partially submerged in the liquid 25.

The biomimetic cilia of the present invention mimic the high compliance and the low beating frequency (10-100 Hz) of naturally-occurring, biological cilia in order to achieve bio-compatible manipulation of microfluids. A further benefit of the highly-compliant biomimetic cilia is their ability to be excited into resonance by various actuation methods, such as physically shaking, electrically, magnetically, acoustically, optically, or thermally in order to achieve microfluid manipulation. Thus, the actuation method can be selected based on the particular vulnerabilities of a given microfluid. The novel manufacturing methods disclosed herein have the additional benefit of lowering the surface energy of the highly compliant cilia to avoid collapse due to interaction energy and surface tension. Another benefit of the manufacturing methods herein is their ability to create biomimetic cilia with specified dimensions (length, width, thickness) and uniform spacing to generate specified fluid flow patterns.

The devices of the invention can be used in a variety of applications, including but not limited to (a) controlling the diffusion rate of chemical reactions, (b) efficiently mixing several different bio/chemical species, and (c) transporting liquid in a controllable way. For example, since the proposed acoustic actuation can be used to activate specific sets of cilia, the devices can be used to develop fluidic valves, and furthermore multi-functional bio chips. Also, diffusion in a multiple phase flow can be controlled using various lengths of cilia. Mixing can be enhanced using the devices, which will shorten the necessary time for bio/chemical reaction. The devices eliminate the complicated, cumbersome fluid transport of current bio-fluidic devices. Moreover, the cilia propulsion will enable a convenient fluid transport in a disposable microfluidic device through remote actuation.

As used herein, the term "biomimetic" means mimicking either one or multiple specific functions of a biological organism. More particularly, biomimetic cilia 20 mimic the high compliance and the low beating frequency of naturally-occurring, biological cilia in order to achieve biocompatible manipulation of micro- or nanofluids. Note that the definition of "biomimetic" excludes cilia that naturally exist in a living organism.

Figure 2:
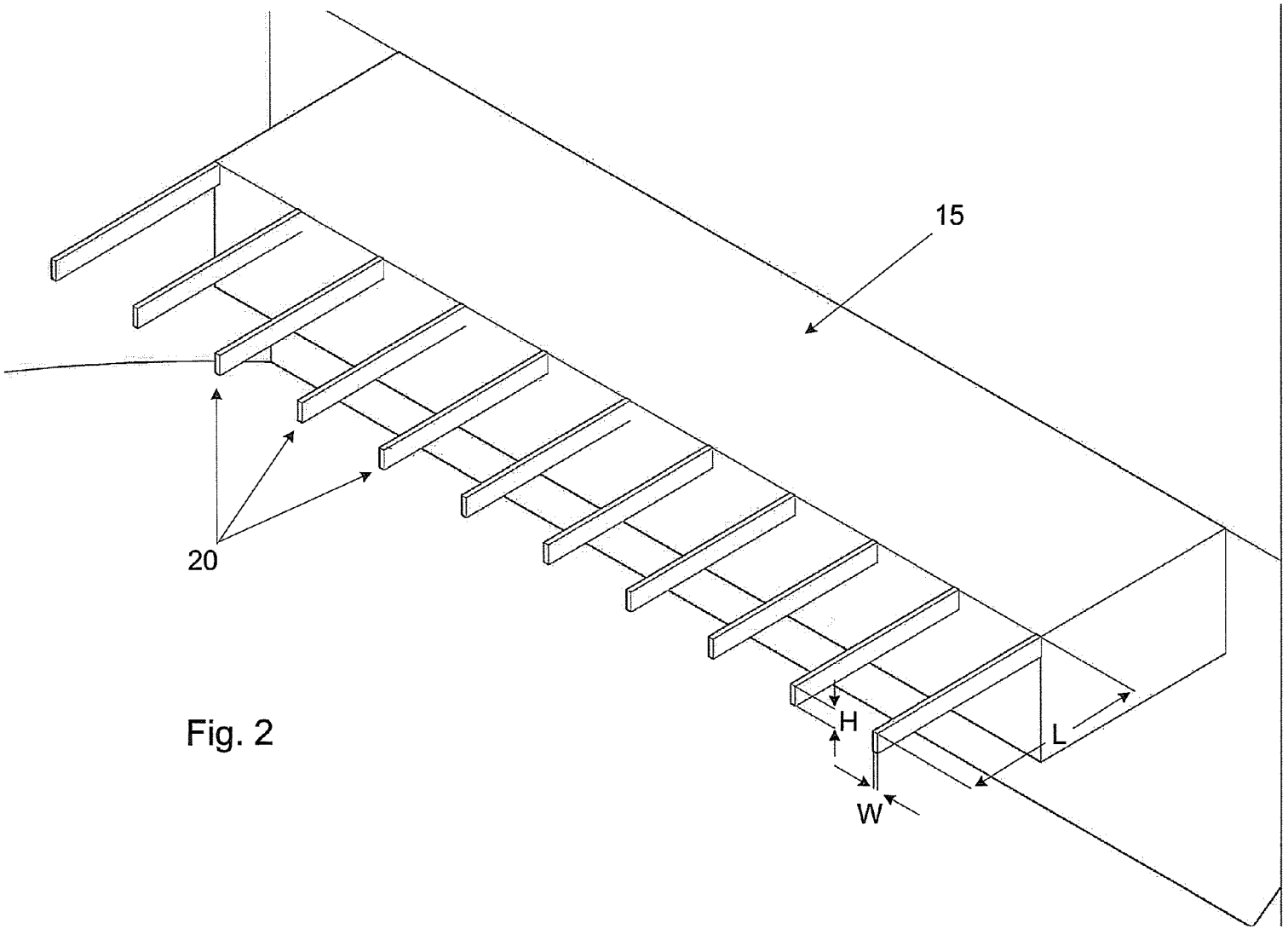
FIG. 2 is a perspective view of the biomimetic cilia's dimensions.
Figure 9C:
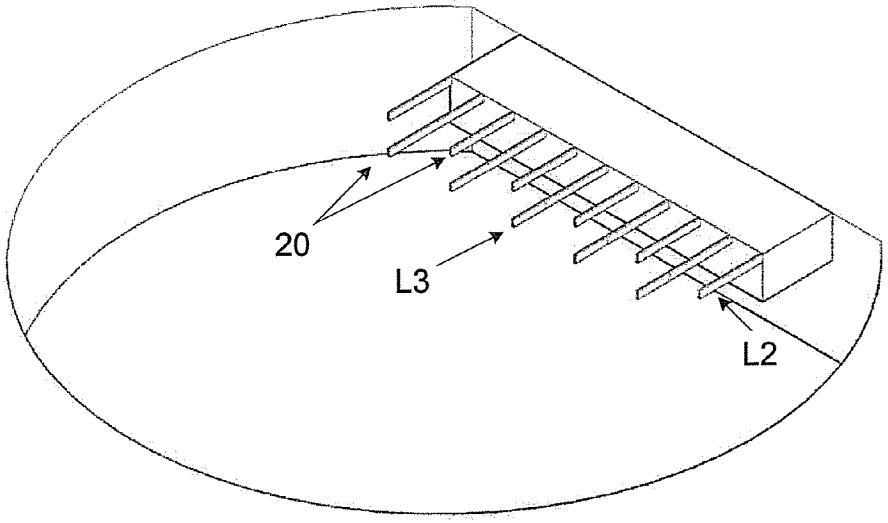
FIG. 9C is a perspective view of one embodiment of a backbone and one or more biomimetic cilia of different lengths.

As used herein, the term "cilia" means either microwires or nanowires with a high aspect ratio of a length "L" that is at least 5 times greater than its width "W", shown in FIG. 2. In one embodiment, the length "L" of each biomimetic cilium is between about 100 nm and 10 mm. The cilia's height "H" may ranges from the length L to the width W. However, the exact dimensions of the cilia are dependent on a particular device's overall dimension and function, as well as the desired resonant frequency of the cilia 20. The plurality of cilia 20 may also be designed to have predetermined varying lengths, as shown in FIG. 9C, such that cilia of one length L2 resonate at a different frequency than cilia of another length L3. This provides flexibility to a user who wants to manipulate various types of micro- or nanofluids. The plurality of cilia may comprise any suitable number of cilia as deemed useful for a given application. In one embodiment, the "effective region" of each cilia tip is a radius of 0.2 L to 2 L from the tip of each cilium in a resting state. Thus, the plurality of cilia may comprise any suitable number of cilia as deemed useful for a given application, and may be provided in any suitable arrangement in a given device (see, for example, exemplary arrangements in FIGS. 1C, and 9A-9C. The cilia could further be arranged around the entirety of the well depending on the intended application.

Figure 13:
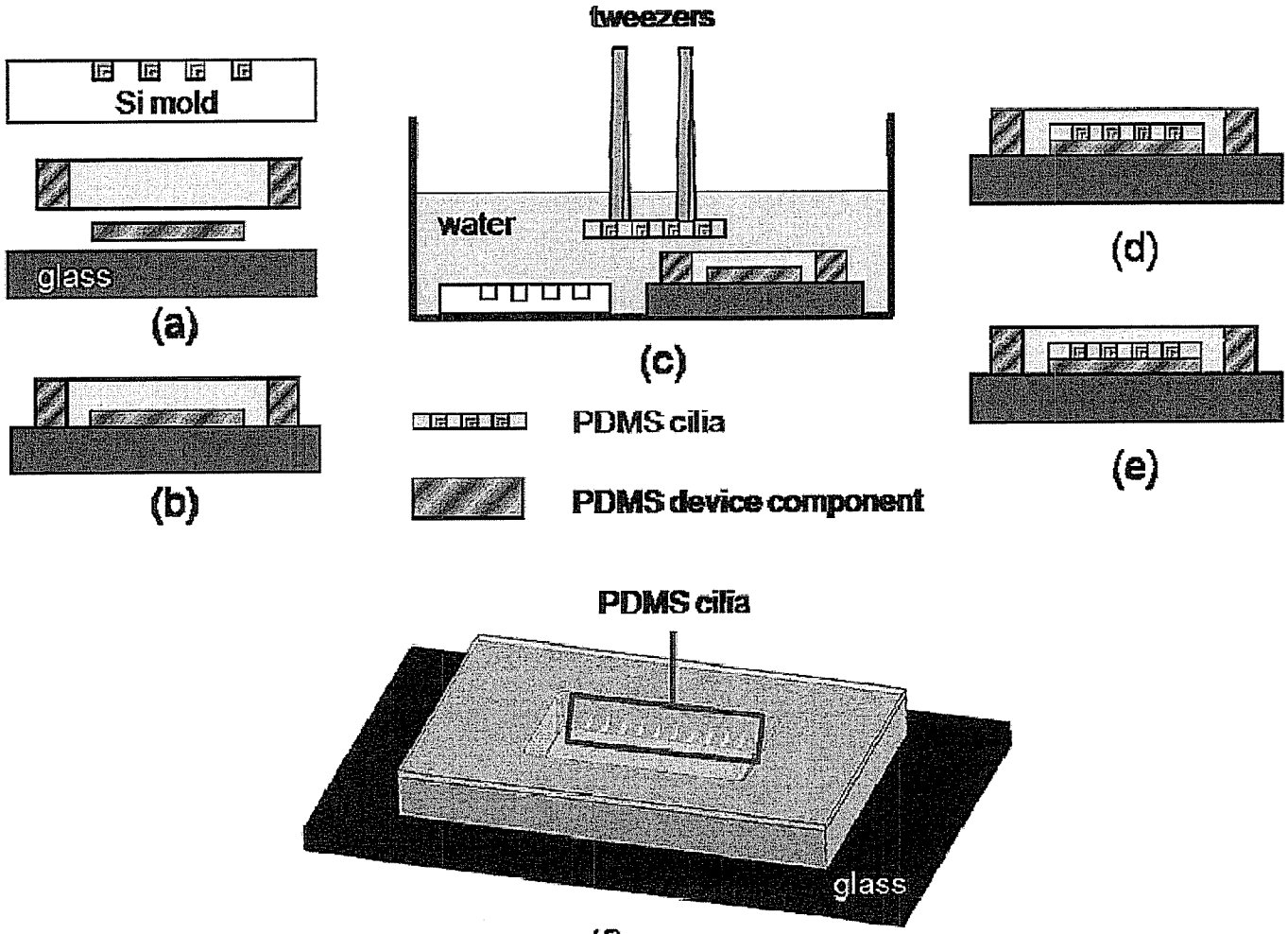

As used herein, the term "backbone" refers to the surface on which one or more cilia 20 can be coupled. The backbone 15 and the plurality of cilia 20 are preferably formed of the same material in the same mold 30 (FIG. 13). In one embodiment, shown in FIGS. 10A-C, the backbone 15 takes the form of a block. In general, individual cilia can be cantilevered such that at least one end is coupled to a backbone or backbone-type structure.

Figure 5B:
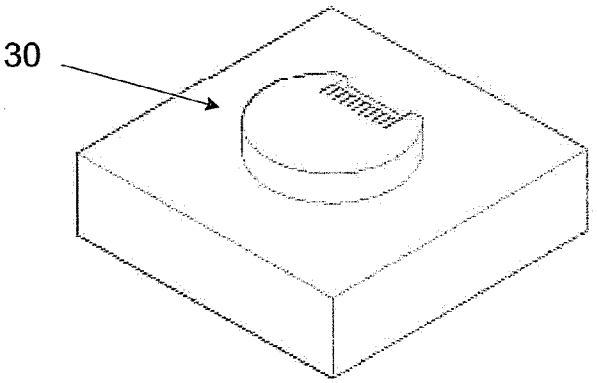
FIG. 5B is a perspective view of an embodiment for a mold of a device comprising one or more biomimetic cilia, a backbone, and a plate.
Figure 5A:
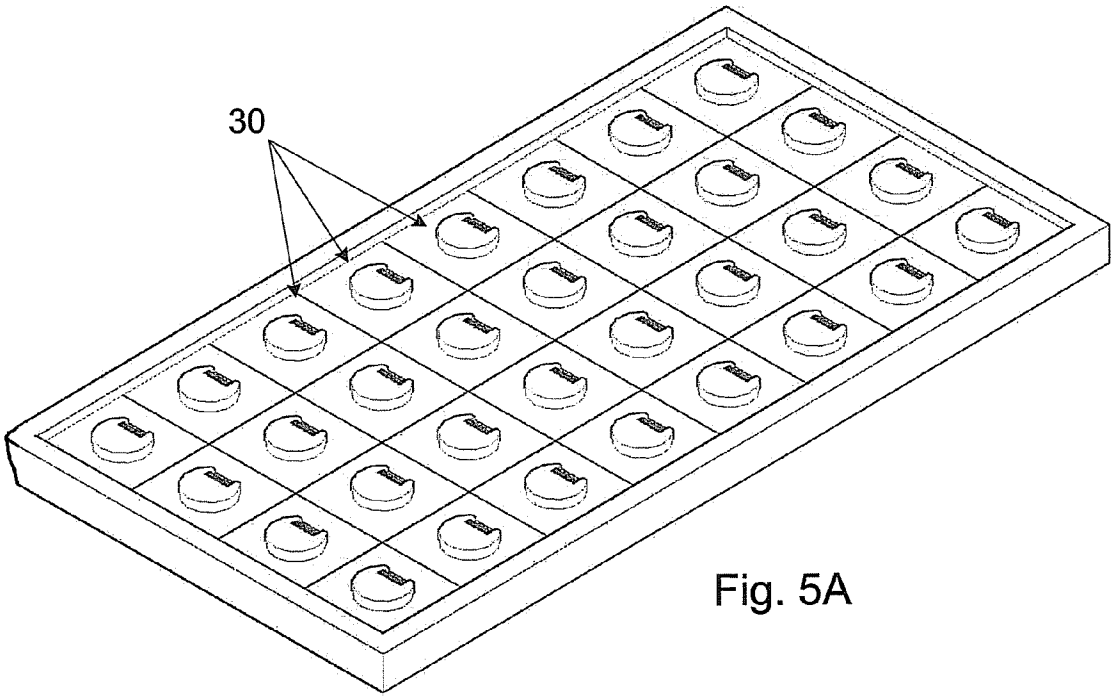
FIG. 5A is a perspective view of an embodiment for a mold of one or more biomimetic cilia devices in the form of a microarray.
Figure 6B:
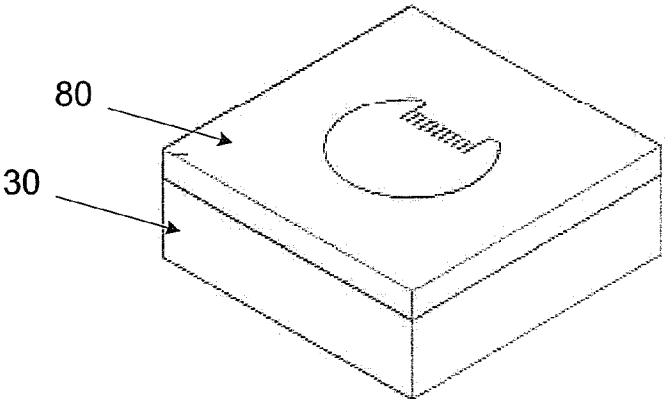
FIG. 6B is a perspective view of the mold of FIG. 5B after polymer mixture's deposition and curing.
Figure 6A:
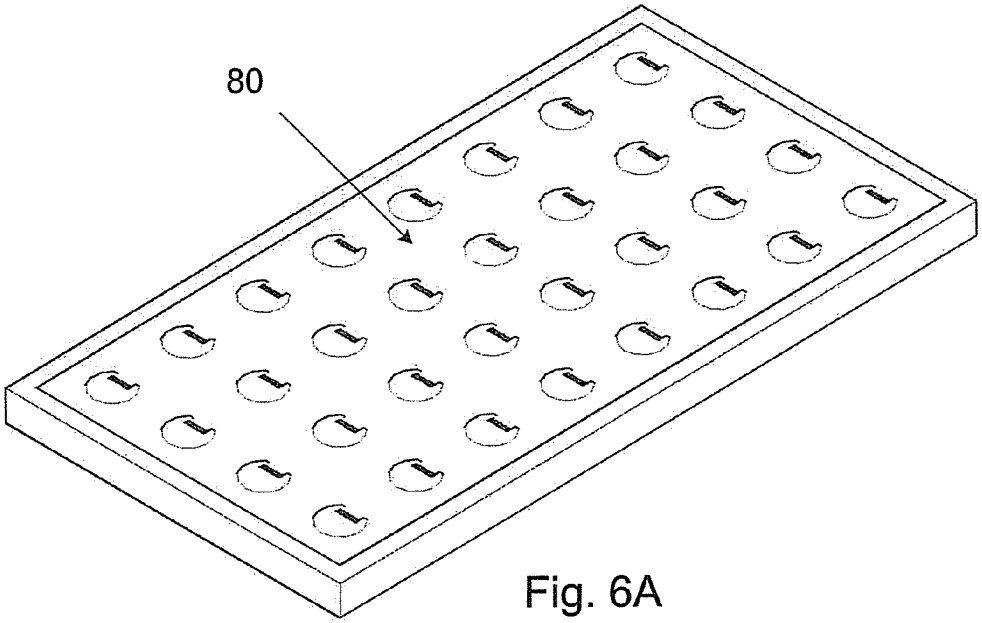
FIG. 6A is a perspective view of the mold of FIG. 5A after polymer mixture's deposition and curing.
Figure 7:
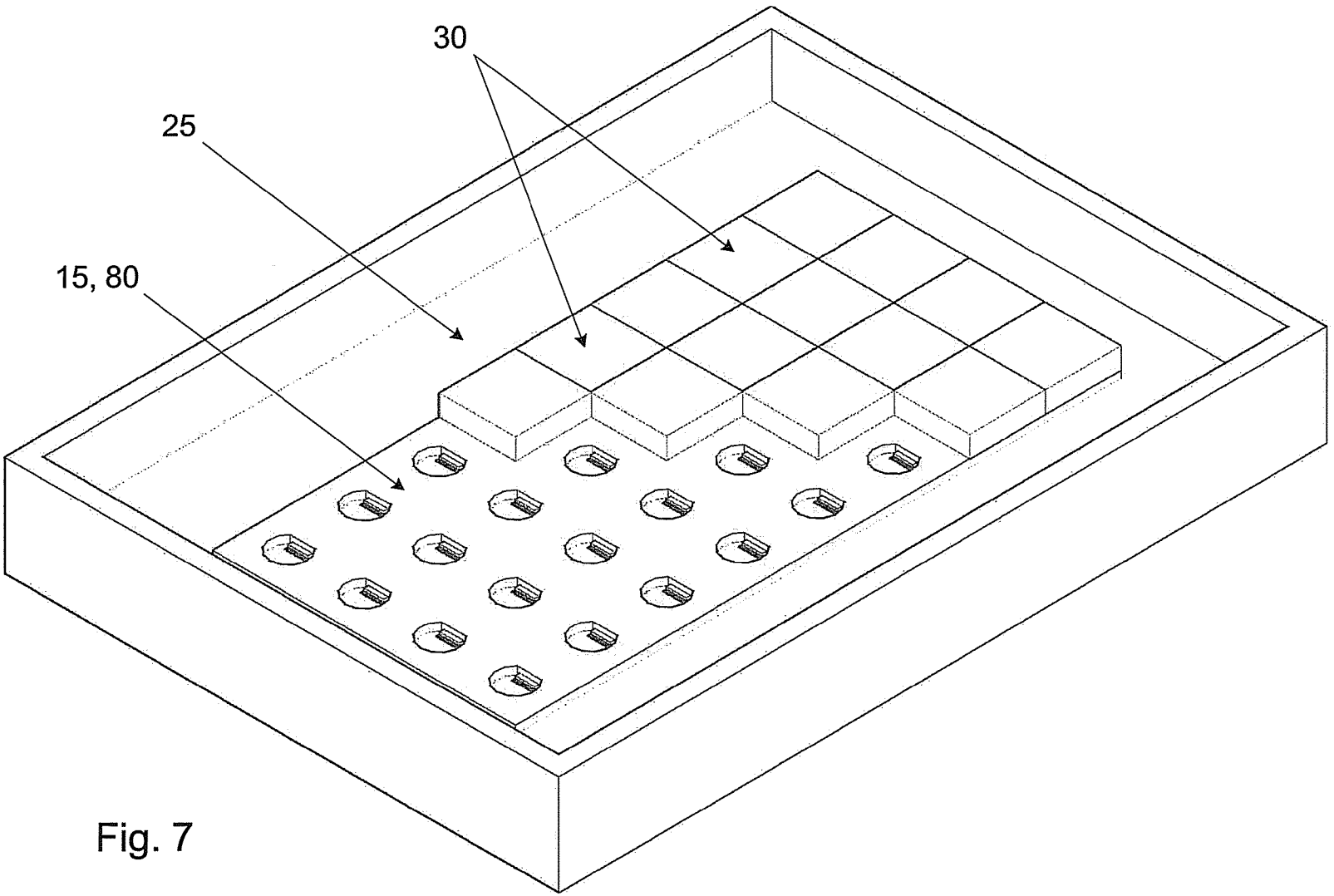
FIG. 7 is a perspective view of the release of the cured mixture while submerged in a liquid.

In an alternative embodiment, shown in FIGS. 1B, 6A-B, and 9A-B, the backbone 15 takes the form of a plate that defines at least one opening 50, and wherein the plurality of biomimetic cilia 20 is disposed in the at least one opening 50. As used herein, the term "plate" refers to a layer of any suitable shape, preferably square, circular, or any polygonal shape. The backbone plate 15 is preferably formed of the same material as the plurality of cilia 20 (FIGS. 5A-B). As shown in FIG. 1B, the backbone plate 15 further defines a backbone block 15 to which is coupled the plurality of cilia 20. This backbone block 15 may be omitted such that the cilia 20 are coupled directly to the planar surface of the backbone plate's opening 50. Examples showing the plate 15 having a plurality of openings are displayed in FIGS. 7-8. In a case where the backbone 15 defines more than one opening 50 (FIG. 7), a non-limiting example of a mold 30 for making the backbone may be a single piece (not shown) or multipart (FIG. 7).

In one embodiment, the backbone has a depth such that the at least one opening 50 forms a well 70 itself that is capable of receiving a micro-fluid upon being mated to a substrate 35. As used herein, the term "substrate" 35 comprises any suitable material, including but not limited to the same material as the backbone, or glass, plastics, a semiconductor, or metal with a substantially planar surface. Alternatively, the substrate 35, the backbone, and the plurality of cilia may be molded as one piece to create the device 10.

In another embodiment, the backbone plate 15 may be mated with an additional layer to either add depth to create a well (FIGS. 1A-C) or to form a closed fluid channel (FIG. 22G). In the case of the closed fluid channel, the additional layer may define a cavity (FIG. 22G) above the opening 50. This cavity can be shaped and sized to lower the pressure in the fluid channel to allow more free motion and improve the efficiency of mixing due to the actuation of the plurality of cilia 20.

The backbone 15 can be dimensioned to provide a gap between the plurality of cilia 20 and any surface that may be disposed below the cilia 20, for example the surface of another device 10 in a stacked arrangement (FIG. 9B), the top surface of a substrate 35 on which the backbone 15 rests (FIG. 10B), or the surface of a fluid channel 70 in a microfluidic apparatus 40 (FIG. 1B-C) in order to allow the cilia 20 a free range of movement in a resonant state. When the cilia 20 are oriented horizontally, that gap is at least as large as the height of the cilia. When the cilia 20 are oriented vertically, that gap is at least as large as the effective region of the lowest cilium tip.

As used herein, the term "liquid disposed" 25 refers to a fluid medium in contact with the plurality of cilia 20, such as during and after release from a mold 30. And the term "partially submerged" means that the liquid 25 is present in any amount suitable to maintain cilia integrity by lowering the surface energy of the highly compliant cilia 20 to avoid collapse due to interaction energy and surface tension. This means the disposed liquid 25 could range from a droplet of liquid 25 in contact with the plurality of cilia 20 to a complete submergence of the cilia 20 in the liquid 25. The liquid 25 may be the same as a buffer solution or a microfluid intended to be acted upon by the plurality of cilia 20. The liquid could also be water, dimethyl sulfoxide (DMSO), or another liquid with a viscosity smaller than 100 mPas. If the device is transferred to a substrate or microfluidic apparatus that is unsubmerged and only a droplet of liquid 25 is to remain in contact with the cilia 20, then the dimensions of the cilia 20 and their spacing dictate the viscosity of the liquid 25 required. In addition, the disposed liquid 25 may change phase to a solid, like water to ice or solidified DMSO, to effectively transport the device 10 without compromising the integrity of the cilia 20. In this case, the maximum viscosity of the liquid droplet is not applicable.

In another preferred embodiment, both the backbone 15 and the plurality of biomimetic cilia 20 are comprised of a polymeric material, such as a silicone-based polymer and are preferably comprised of polydimethylsiloxane. Alternatively, the plurality of biomimetic cilia 20 are comprised of a nanomaterial, such as a hybrid nanofiber (see, e.g., "Hybrid Fiber Fabrication Using an AC Electric Field and Capillary Action", ASME conference, IMECE 2007-42305, Seattle, Wash., Nov. 11-15, 2007 and U.S. patent application Ser. No. 12/606,778 filed Oct. 27, 2009, entitled "hybrid fibers, devices using hybrid fibers, and methods for making hybrid fibers"). The plurality of biomimetic cilia 20 may also be comprised of biopolymers, including but not limited to polypeptides, nucleic acids, lipids, carbohydrates, polyphenols, and combinations thereof. An additional embodiment provides that each biomimetic cilium 20 comprises a material with a Young's modulus of between 10 kPa and 1 GPa. Maintaining a Young's modulus in this range renders the cilia 20 highly compliant and capable of achieving resonance at low beating frequencies.

As shown in FIGS. 4A-C, the distance "S" between cilia can be designed to induce specified fluid flow patterns 55, 60 in a micro- or nanofluid depending on a desired function of a device. For example, in an embodiment in which each cilium in the plurality of biomimetic cilia 20 has substantially the same length "L1" and the plurality of biomimetic cilia are spaced apart (S3) by a distance greater than half of the length "L1" of each biomimetic cilium, the device 10 can be used as a mixer 55 (FIG. 4B). In an alternative embodiment, each cilium in the plurality of biomimetic cilia 20 has substantially the same length "L1" and the plurality of biomimetic cilia 20 are spaced apart (S2) by a distance less than half of the length (L1) of each biomimetic cilium, the device 10 can be used for a pump 60 to generate hydrostatic pressure (FIG. 4C). In yet another embodiment, in Fig. A, the cilia may be spaced apart "S1" by a distance equal to half of the length "L1" of each biomimetic cilium such that neither mixing 55 nor pumping 60 fluid flow patterns dominate. In addition, the dimension of the cilia's height (H) can control a twisting or torsional motion that further facilitates mixing.

Figure 3:
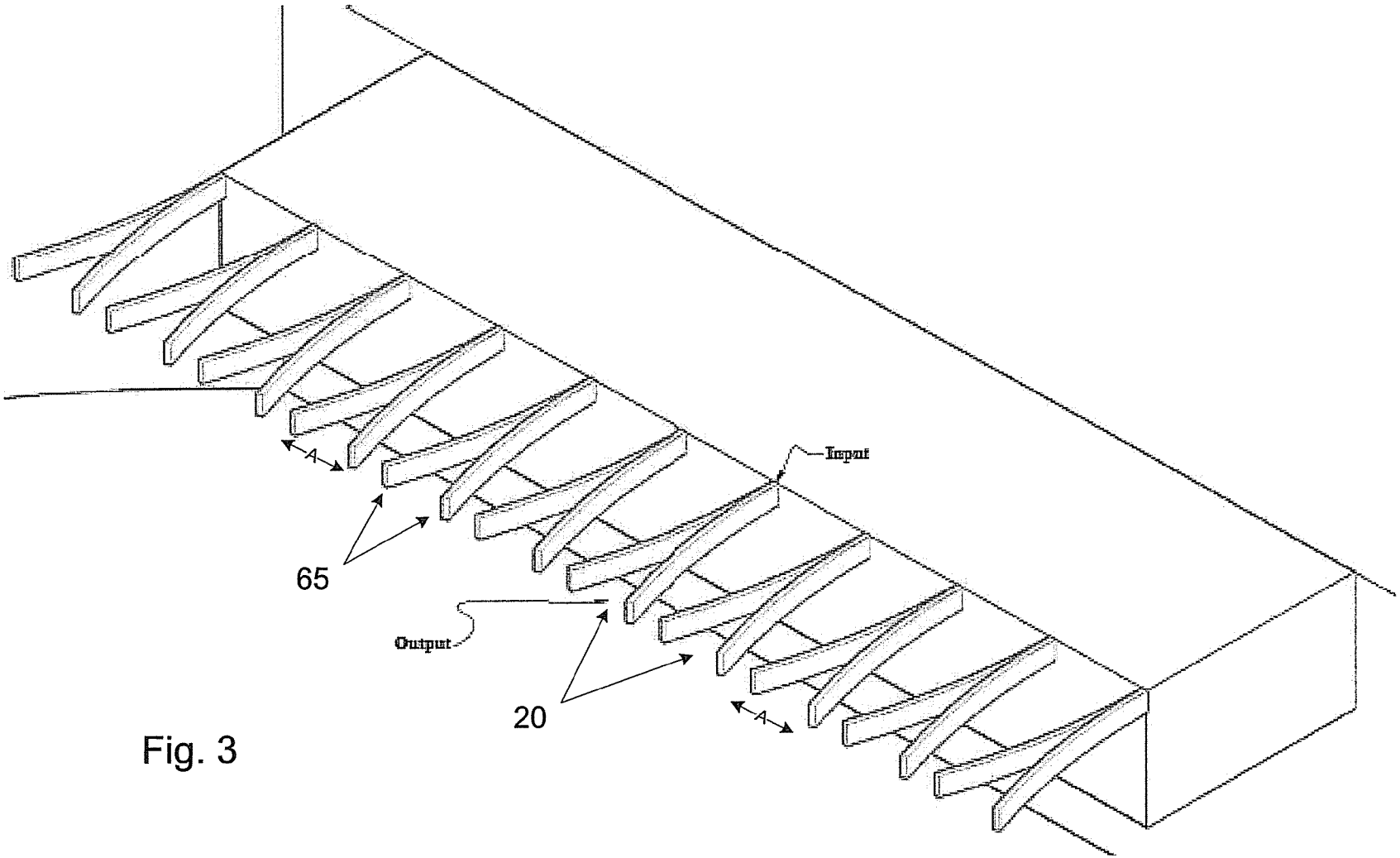
FIG. 3 is a perspective view of the amplitude achieved at the output end of the biomimetic cilia when they are excited into resonance.

As shown in FIG. 3, in a further embodiment, one or more biomimetic cilia of the plurality of biomimetic cilia 20 are arranged to be excited into resonance. As used herein, "resonance" is the state in which the cilia oscillate at a larger amplitude "A" at low beat frequencies (10-100 Hz) than at other frequencies. And the amplitude "A" is the displacement of the output end 65 of each cilium during a complete oscillation. The excitation can be sinusoidal, asymmetric, or pulse type input.

An additional embodiment further comprises one or more actuators (not shown) configured to induce resonance in one or more biomimetic cilia of the plurality of biomimetic cilia 20. Examples of one or more actuators are any suitable actuator known in the art that may be activated electrically, magnetically, acoustically, optically, or thermally. In addition, the one or more actuators could be a human hand or manipulation tool capable of physically shaking the device 10. The actuators may be connected to the device 10 physically, acoustically, electrically magnetically, fluidly, or thermally, for example. So the actuation method can be selected based on the particular vulnerabilities of a given micro- or nanofluid. Also, when more than one device 10 is employed in a microfluidic apparatus 40, as discussed below, each device 10 may be controlled separately or in combination using the same or different actuators.

Further non-limiting examples of the devices of this aspect of the invention are disclosed in the examples that follow.

In a second aspect, a microfluidic apparatus 40 comprises one or more of the devices 10 described above, wherein the plurality of biomimetic cilia 20 are disposed in at least one fluid channel 70. All embodiments of the devices as disclosed herein may be used in this aspect of the invention. Non-limiting examples of the microfluidic apparatuses of this aspect of the invention are disclosed in the examples that follow.

As used herein, the term "microfluidic apparatus" is an apparatus having at least one "fluid channel" in the form of a microchannel, trench, line, recess, or well, having a cross-sectional dimension below 1000 micrometers and which offer benefits such as increased throughput and reduction of reaction volumes. For example and not by way of limitation, the microfluidic apparatus may comprise a microarray of wells, a microelectronic component for heat exchange and cooling, a synthetic article for deployment in a bio-organism, or a propulsion mechanism for a micro-robot.

In embodiments with more than one fluid channel 70, the channels 70 may be separate and arranged in an array, for example, or may be designed to intersect. The fluid channels 70 receive a fluid to be manipulated by the plurality of biomimetic cilia. In operation, the ratio of the density of each individual biomimetic cilium to the density of the microfluid is in the range of 0.01 to 1.2.

Figure 8:
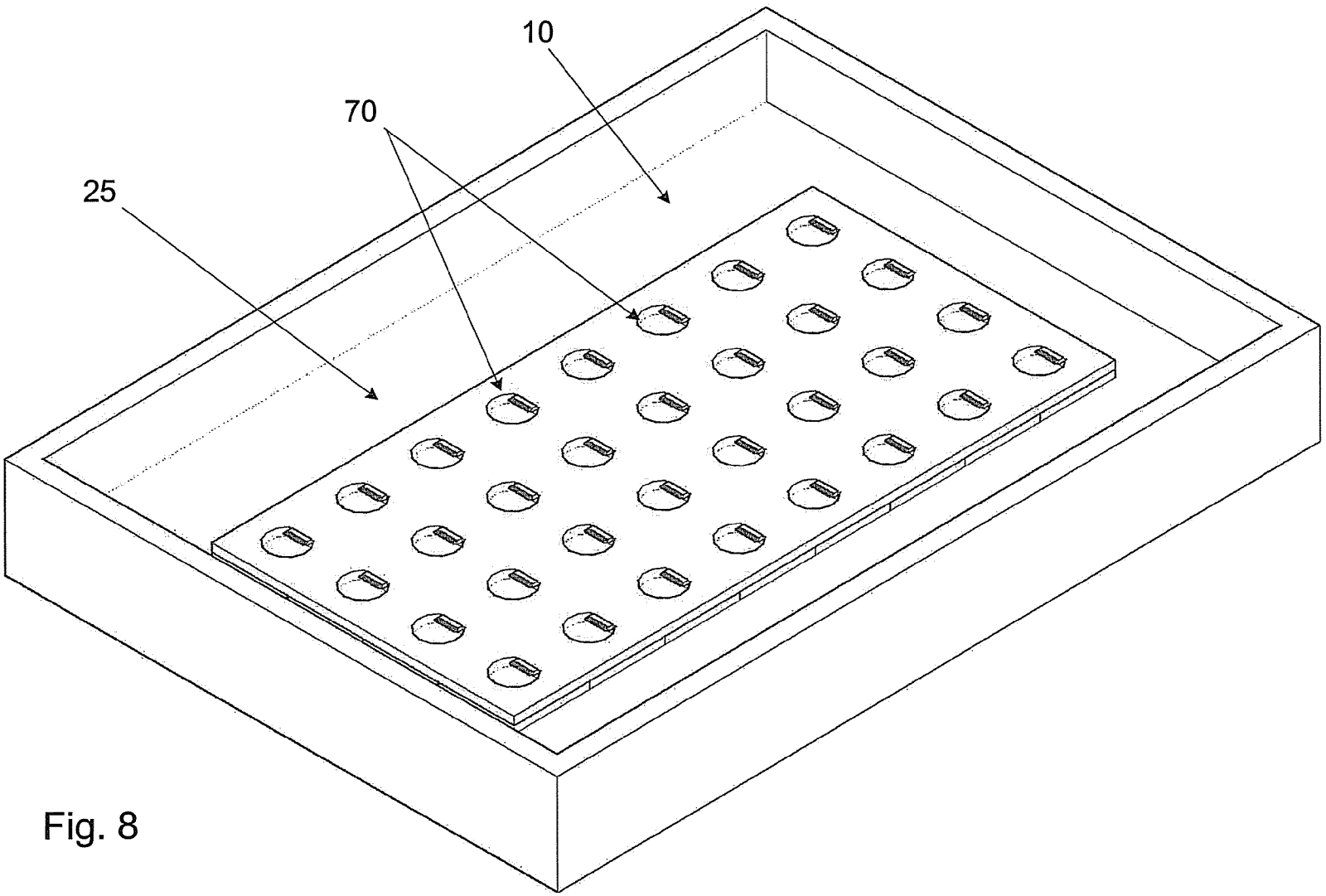
FIG. 8 is a perspective view of the cured mixture uprighted and transferred to substrate while submerged in a liquid.
Figure 9B:
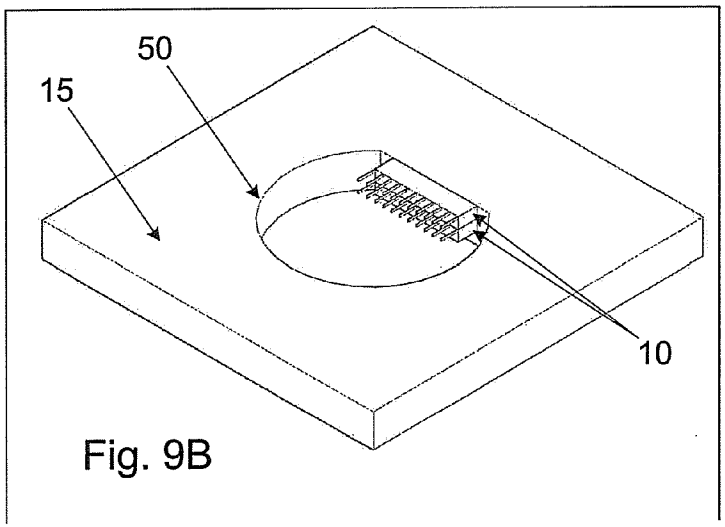
FIG. 9B is a perspective view of one embodiment with two backbones each coupled to one or more biomimetic cilia aligned on top of one another.
Figure 9A:
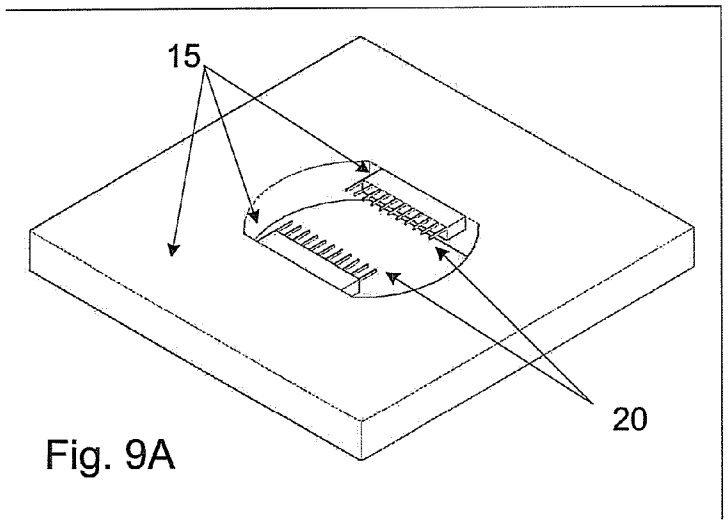
FIG. 9A is a perspective view of one embodiment with two backbones each coupled to one or more biomimetic cilia on opposite sides of a well.

In one embodiment, shown in FIGS. 1A-B and 8, the microfluidic apparatus 40 comprises one or more wells 70, and wherein a cavity 75 defined by each of the one or more of the wells 70 includes the plurality of biomimetic cilia 20. A "well" as used herein, is a cavity 70 designed to receive a micro- or nanofluid. In embodiments with more than one set of cilia 20 per well 70, as shown in FIGS. 9A-B, each set of cilia may be actuated by separate actuators, or the plurality of cilia 20 may be dimensioned to activate at different low beat frequencies, or the plurality of cilia 20 may work in cooperation at the same frequency. The multiple sets of the plurality of cilia 20 may be arranged, for example, horizontally in a single stacked row, in rows on opposing sides of the well, vertically in a column, orthogonal to one another, or diagonally. Numerous arrangements the cilia 20 are contemplated and the foregoing list is not intended to be exhaustive. In an embodiment in which cilia are arranged both horizontally and vertically in a fluid channel, this would result in a three dimensional flow configuration. Regardless of the cilia's orientation, cilia that share the same length and width will resonate at the same frequency.

Another embodiment, illustrated in FIGS. 1A-B, further comprises: a substrate 35 underlying the backbone, wherein the backbone 15 takes the form of a plate that defines at least one opening 50 that in this embodiment serves as wells 70, and wherein the plurality of biomimetic cilia 20 is disposed in the at least one well 70. In an embodiment in which the substrate 35 and backbone 15 are not molded in one piece, these components are bonded together via known techniques, such as PDMS bonding or oxidizing. In another embodiment, the device comprises a top layer disposed over the backbone, wherein the top layer comprises one or more openings having a cross-section at least as wide as that of the plate openings, wherein one or more of the top layer openings and the plate openings mate to define an opening of increased depth relative to the plate opening. This embodiment can be used, for example, in fabricating fluidic channels (see, for example FIG. 22(*g*)).

In a third aspect, a method for manufacturing biomimetic cilia comprises: (a) creating a mold in the form of one or more biomimetic cilia, wherein each biomimetic cilium has a length that is at least 5 times greater than its width, (b) pouring a mixture of a polymeric material and curing agent into the silicon mold, (c) vacuuming the mold to remove air bubbles from the mixture, (d) removing excess mixture from the mold, (e) curing the mixture in the silicon mold, (f) placing the silicon mold and mixture in a liquid, (g) releasing the cured mixture from the silicon mold while submerged in the liquid, (h) transferring the cured mixture to a substrate 35, and (i) bonding the cured mixture to the substrate. This third aspect is illustrated in FIGS. 5-8, which shows (a) a silicon mold 30 in the form of a plurality of biomimetic cilia 20, wherein each biomimetic cilium has a length that is at least 5 times greater than its width, (b) a mixture 80 of a polymeric material and curing agent after pouring into the silicon mold 30, (c) the silicon mold 30 and mixture 80 placed in a liquid 25, and the cured mixture 80 transferred and bonded to a substrate 35. This aspect can be used to make any of the devices disclosed herein. Non-limiting examples of the methods of this aspect of the invention are disclosed in the examples that follow.

By placing the cured mixture 80 in a liquid 25 and releasing the mixture 80 from the mold 30, the novel manufacturing method utilizes the lower surface energy of the cilia 20 in solution to avoid cilia collapse due to the surface tension effects.

In one embodiment, the step of creating a silicon mold 30 further comprises: (a) patterning a silicon wafer by photolithography, (b) performing deep reactive ion etching on the silicon wafer, (c) removing Bosch polymers from the silicon wafer, (d) stripping a photoresist from the silicon wafer, (e) rinsing the silicon wafer in de-ionized water, and (f) silanizing the silicon wafer.

In one embodiment, the step of transferring further comprises the substrate 35 being submerged in the liquid 25. In an alternative embodiment, the step of transferring further comprises the liquid 25 remaining disposed among the biomimetic cilia 20 when placed on an unsubmerged substrate 35.

The step of bonding can be accomplished using an adhesive or via nonspecific binding, PDMS bonding, or oxidizing, for example.

Figure 22:
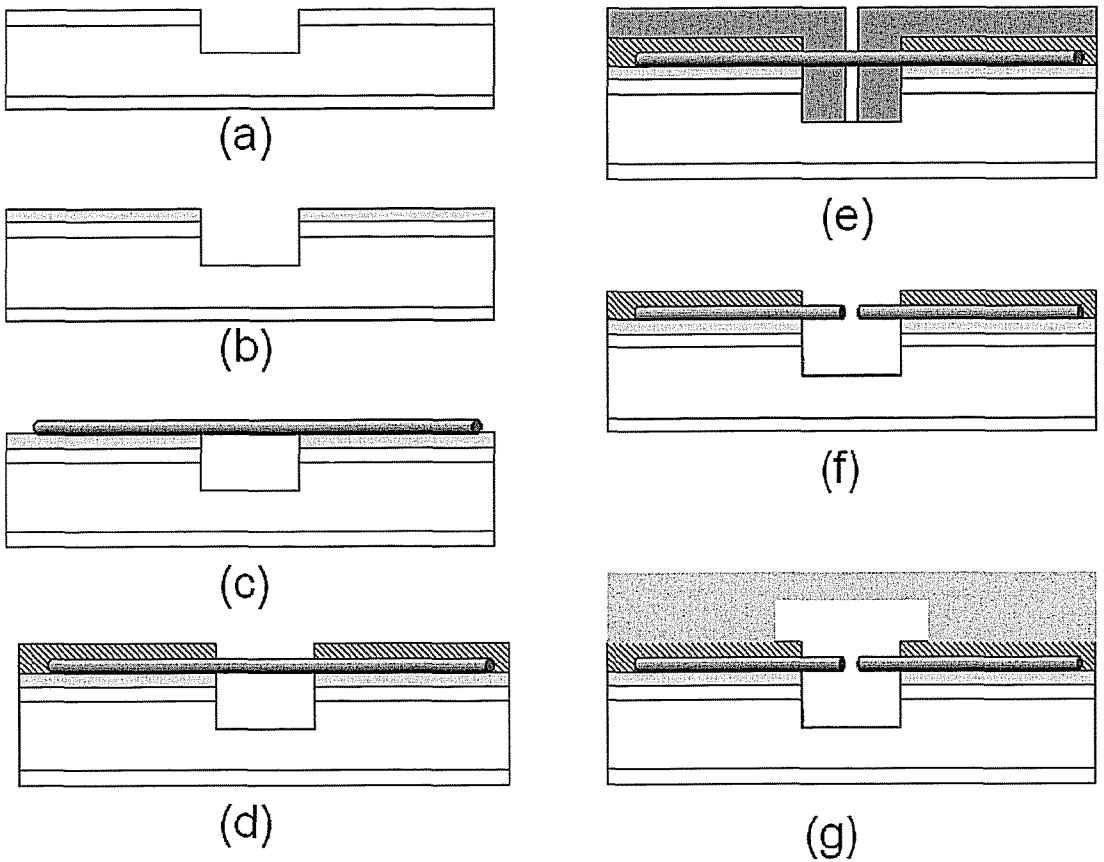

Another method for manufacturing biomimetic cilia and placing them in a fluidic device is shown in FIG. 22. The method comprises: (a) thermally growing an oxide layer (500 nm) on an Si wafer to fabricate an electric insulation layer (FIG. 22A), (b) patterning the oxide layer to create a trench by a reactive ion etching (RIE) (FIG. 22A), (c) depositing Cr/Au electrodes on the oxide layer for SiC cilia assembly (FIG.

22B), (d) aligning SiC cilia by an electric field guided assembly method on the electrodes (FIG. 22C), (e) depositing an additional metal layer (Al) on the SiC cilia to mechanically clamp the assembled SiC cilia (FIG. 22D), (f) patterning the cilia by several micromachining steps since the lengths of SiC cilia are not uniform, (g) spin-coating and patterning photoresist on the SiC assembled device (FIG. 22E), (h) performing RIE through the thin slit of the photoresist to etch the center region of the SiC cilia followed by removing the photoresist, (i) suspending the SiC cilia by a CO2-critical point drier (FIG. 22F), (j) covering the assembled device with a poly dimethylsiloxane (PDMS) mold (FIG. 22G).

In a fourth aspect, a method for using the microfluidic apparatus described above comprises: (a) introducing a microfluid into the fluid channel, (b) exciting one or more of the plurality of biomimetic cilia into resonance, and (c) mixing or pumping the microfluid via the one or more of plurality of biomimetic cilia in resonance. All embodiments of the devices as disclosed herein can be used in the methods of this further aspect of the invention. Non-limiting examples of the methods of this aspect of the invention are disclosed in the examples that follow.

In a fifth aspect, a mold for preparing at least one backbone and one or more cilia coupled to the backbone is comprised of a silicon wafer able to be patterned by photolithography and manipulated by deep reactive ion etching. The pattern is dictated by the desired shape of the backbone and desired dimensions and spacing of the cilia. As shown in FIGS. 5A-B, the mold may create a device 10 with a backbone plate 15 defining one or more openings 50 each with a plurality of cilia 20. Alternatively, the mold 30 may create a device 10 with backbone block 15 and a plurality of cilia 20 (FIG. 13). In each embodiment, the desired depth of the backbone plate is determined by the depth of the reactive ion etching. The molds of this aspect of the invention can be designed to produce any of the devices disclosed herein. Non-limiting examples of the molds of this aspect of the invention are disclosed in the examples that follow.

Each embodiment of the device or microfluidic apparatus can be used in the methods of the third and fourth aspects of the invention.

Note that any of the foregoing embodiments of any aspect may be combined together to practice the claimed invention.

Example One

Biomimetic Silicone Cilia for Microfluid Manipulation

I. Experimental Configuration

To demonstrate the underwater fabrication process, a device was fabricated as shown in FIGS. 10A-C. The device was composed of a 1 mm-thick glass slide, a chamber, a supporting block, a cilia structure, and a cover plate as shown in FIGS. 10A-C. The fluidic chamber was made of a cured 2 mm-thick PDMS plate. The PDMS plate had a 27 mm×7 mm (W×D) rectangular window in the center. A 25 mm×5 mm×0.7 mm (W×D×H) PDMS block was prepared to support a cilia structure. The device was covered with a 0.4 mm PDMS plate. A cilia array was assembled in a fluidic device with the underwater fabrication process, described below.

FIG. 11 shows the schematics of the experimental set-up to excite the cilia, measure the cilia response, and also trace the microfluid motion. For the excitation of the cilia device, a leadzirconate-titanate (PZT) microstage (PZS-200, Burleigh Instruments, Inc.) was controlled by a signal generator (33220A, Agilent) and a high voltage amplifier (PZ-150M, Burleigh Instruments, Inc.). By manipulating the signal generator and the amplifier, the frequency and excitation amplitude of the PZT actuator was controlled. The excitation amplitude of the cilia device was manipulated to 10, 20, and 30 m through an inductive sensor (SMU-9000-15N, Kaman Sensor Systems). The cilia motion was captured through a charged coupled device (CCD) camera (DXC-390, Sony Electronics Inc.) and video-recorded (Dazzle digital video creator 150, Pinnacle Systems) through a light microscope. The fluid flow induced by the cilia was traced by tracking microspheres immersed in the fluid. The cilia device was clamped to the PZT microstage under a microscope.

II. Process for Fabrication of a Cilia Fluidic Device

The fabrication of the cilia fluid device consists of three steps: (1) silicon mold fabrication, (2) PDMS cilia fabrication, and (3) assembly of the fluid device by the underwater fabrication method. These three steps are described below.

The first step is represented from FIGS. 12A-C. Si wafers (orientation: 100, p-type, 4 inch in diameter) were prepared and a photoresist layer was spin-coated and patterned on the substrate (FIG. 12A). Deep reactive ion etching (DRIE) with the standard Bosch process (ICP 380, Oxford Instruments) was then used to fabricate a high-aspect-ratio Si structure (FIG. 12B). To remove the Bosch polymers generated in DRIE, the wafer was etched by an O2 plasma at 300 W power for 10 minutes (Model 2000, Branson), followed by stripping the photoresist in a H2O2+H2SO4 mixture (1:3) for 10 minutes. The processed wafer was rinsed in flowing de-ionized (DI) water for 15 minutes. After drying the Si mold by a nitrogen gas flow, it was silanized with tridecafluoro-1,1,2,2-tetrahydroctyl-1-trichlorosilane (United Chemical Technologies, Inc.) for 4 hours in a desiccator in order to form a monolayer (FIG. 12C). The second step, the fabrication of cilia structures, is presented in FIGS. 12D-F. PDMS prepolymer and curing agent (Sylgard 184, Dow Corning Corp.) were mixed at the weight ratio of 10:1 and poured over the mold (FIG. 12D). The mold was vacuumed for 15 minutes for the cilia to remove bubbles in the mixture. After removing the bubbles, the excessive PDMS mixture was scraped by using a flat piece of PDMS block (FIG. 12E) followed by curing at 70 degrees C. for a day (FIG. 12F). Subsequently, the cilia structure was released from the master mold.

Cured PDMS cilia structures were prepared as an array of cantilevers having dimensions of 10 m×75 m×400 m (W×H×L), and a spacing of cilia is 200 m, as shown in FIGS. 10A-C. The cilia structure was released from a Si mold in both air and water in order to study how the interfacial energy affected the failure of the cilia structures. For the cilia released in air, water was introduced into the device in order to investigate the effect of surface tension. With respect to the release in water (underwater fabrication), the cured PDMS cilia were released and assembled as described in FIGS. 13A-F. Then the cilia structures for both cases were observed under a microscope.

The third step of the cilia device fabrication is performed by underwater fabrication as illustrated in FIGS. 13A-F. Cured PDMS cilia in a Si mold and device components were prepared as shown in FIG. 13A. Microfluidic device components were assembled by the stamp-and-stick bonding process (FIG. 13B). Subsequently, both the cured PDMS cilia array in the mold and the fluidic device were immersed in a water bath. For the underwater fabrication, the cilia array was released from the mold by using tweezers in water. Then the cilia structure was positioned on the PDMS supporting block in water (FIG. 13C). After the assembly of the cilia in water, the assembled device was released from the water bath. Flooded water on the surface of the device was completely wiped (FIG. 13D). Finally, a 0.4 mm-thick PDMS plate was placed on top of the device for covering the cilia immersed in water (FIG. 13E). FIG. 13F shows 3-dimensional schematics of the cilia device and the picture of the cilia device, respectively.

III. Frequency Response Test

To characterize the vibrational response of the PDMS cilia in water, the cilia device shown in FIGS. 10A-C was excited by a PZT microstage. The sinusoidal input frequencies were manipulated by a signal generator from 30 Hz to 100 Hz to investigate the resonance frequency. The output voltage of the signal generator was 200 mVpp. The excitation amplitude of the PZT microstage was 20 m for the frequency response test. At each frequency, the amplitude of a cilium was captured through a CCD camera and a light microscope. The capturing rate of the camera was 30 frames per second. The shutter of the camera was open and refreshed every 1/30 seconds. Thus the imaging system could continuously trace the trajectory of cilia motion. 'L' and 'W' refer to the longitudinal length and the width of the cilia, respectively. 'B' indicates the actuation distance of the cilium base and 'T' means the tip actuation distance of the cilium. In each still-image, the amplitude ratio (T/B) was measured with 'ImageJ' software (ImageJ, U.S. National Institutes of Health, Bethesda, Md., USA). The cilia showed resonance at 65 Hz.

IV. Observation of Cilia-Induced Flow

An assembled PDMS cilia array illustrated in FIGS. 10A-C was used to demonstrate the generation of fluid flow patterns around an array of resonating cilia. During the underwater fabrication process, microspheres (mean diameter: 18.97 m, Bangs Laboratories, Inc.) were suspended in water in the device in order to trace the fluid flow patterns.

The PDMS cilia were operated at a resonance frequency of 65 Hz in the device. The channel dimension and the built-up pressure could affect the resonance frequency. The excitation amplitude was controlled to 10, 20, and 30 m in order to study the change of fluid flow according to the excitation amplitude. The movements of microspheres were video-captured and the video files were converted to sequential still images. The image files were analyzed through the Image J and its plug-in software "MTrackJ" (Biomedical Imaging Group Rotterdam of the Erasmus MC—University Medical Center Rotterdam, Netherlands) in order to trace the paths of the selected microspheres.

V. Simulation

To understand the flow pattern generated by cilia, simulations were performed using the software COMSOL Multiphysics®. A 2-dimensional simulation model was developed in the fluid-structure interaction mode of the micro-electro-mechanical-system (MEMS) module. The model was composed of the incompressible Navier-Stokes equations for flow analysis, plane strain analysis for structure deformation, and the arbitrary-Lagrangian-Eulerian (ALE) method for solving the moving boundary problem. The fluid flow in the model was described by Navier-Stokes equations and the continuity equation in order to solve the velocity and pressure. These equations are:

$$\rho\frac{\partial\vec{u}}{\partial t} - \nabla\cdot\left[-p\vec{I} + \eta\left(\nabla\vec{u} + (\nabla\vec{u})^T\right)\right] + \rho(\vec{u}\cdot\nabla)\vec{u} = \vec{F}'$$

$$\nabla\cdot\vec{u} = 0$$

where ρ is the density of the fluid, $\vec{u}$ is the velocity field, p is pressure, $\vec{I}$ is the unit diagonal matrix, η is the viscosity of the fluid, and $\vec{F}$ is the cilia force affecting the fluid.

The structural deformation of cilia was calculated by the fluid load:

$$\vec{L} = -\vec{n}\cdot(-p\vec{I} + \eta(\nabla\vec{u} + (\nabla\vec{u})^T))$$

where $\vec{L}$ is the load from the fluid, and $\vec{n}$ is the normal vector to the structure boundary. Note that shear force acting on cilia is not considered because the longitudinal deformation of cilia is negligible.

FIG. 14 represents the geometry of the simulation model. The model contains seven cilia having a rectangular are of 400 μm×10 μm with 200 μm spacing. The cilia were attached to a supporting block. The thickness of the cilia was 75 μm for the calculation of fluid load on each cilium. The density of the cilia was 980 kg m-3 and the fluid density was 1000 kg m-3. The Young's modulus of the cilia structure was 750 kPa and the fluid viscosity was 10-3 Pa·s.

Regarding the boundary conditions, the support was excited in the x-direction with 65 Hz sinusoidal signal with amplitude of 20 m. The cilia were free to respond to the load exerted by the fluid flow. The fluid loads were computed from the velocity and pressure fields obtained from solutions of the Navier-Stokes equations. The side boundary conditions of the fluid domain were neutral, meaning that the boundary forces were zero. No slip boundary conditions (=0) were applied to the top of the fluid domain and the surface of the support. The purpose of the simulation model was used to interpret the experimental results.

VI. Simulation Result of Cilia-Induced Flow

FIGS. 15A-D show the velocity vectors of the fluid flow due to the cilia motion in the computational domain and the selected regions, respectively. The velocity vectors in the figure were averaged for ten periods (10/65 seconds) because the flow velocity was continuously changing in an oscillatory manner due to the cilia motion. Rotational flows were generated at the tip of the each cilium and propulsive flows were formed right above the cilia. FIG. 15B shows velocity vectors in the region R and FIG. 15C presents velocity vectors near a cilium (the region R1). According to these simulation results, the spheres located near the tip of each cilium move in a circular manner due to the rotational flow. Particles above the cilia are ejected outwards. FIG. 15D presents velocity vector in the region R1. In R1, the microspheres move to y-direction with a wobbling motion in x-direction.

VII. Underwater Fabrication—Experimental Results

When the cilia structures were released from the Si mold into air, most of the structures were found to be successfully fabricated. The structures, however, completely collapsed due to surface tension when water was introduced to the cilia structure.

When the underwater fabrication was performed, the cilia collapse was successfully avoided due to the reduced interfacial energy. Because air was not involved in the process, surface tension-induced failures could be avoided. Thus the cilia structures were successfully fabricated by using the underwater fabrication method.

VIII. Frequency Response Test—Experimental Results

The resonance frequency of PDMS cilia was measured in water by varying excitation frequencies from 30 Hz to 100 Hz. The tip amplitude at 65 Hz was the highest among the tested frequencies. It should be noted that the resonance frequency in water could vary according to the device configuration because the fluid flow of the solution in the device could be changed depending upon the solution volume and device configuration.

FIG. 16 shows the frequency response of the observed cilia motion in terms of the relative amplitude (T/B) of the tip displacement (T) to the base (B) of cilia in water. The highest amplitude at the tip was 2.6 times the base displacement at 65 Hz sinusoidal frequency.

IX. Fluid Flow Observation—Experimental Results

The trajectories of microspheres in the fluid device by cilia actuation at the frequency of 65 Hz and at excitation amplitudes of 20 and 30 μm. The trajectories show the motion of four microspheres in the vicinity of resonating cilia. The microspheres move in the y-direction with an oscillatory and zigzag motion between neighboring cilia. The microspheres exhibit circular motion, similar to what was observed in the numerical simulations due to the rotational flow around cilia tips. Right above each cilium, the microspheres are ejected in the y-direction. As the excitation amplitudes increased from 20 to 30 μm, the flow velocities also increased but the flow pattern appears similar for both cases. For the different excitation amplitudes of 10, 20, and 30 μm, the average velocities of microspheres were increased in the y-direction as shown in FIG. 17A. For these results, the average velocities of the selected microspheres were measured in the area near the displaced cilia tip. Overall, the experimental results qualitatively agree with the simulation results, in that a rotational flow is generated in the vicinity of cilia tips while the propulsive flow in the y-direction is generated above the cilia tips.

To use the cilia device for a specific purpose (e.g. a micromixer or a micropump), the geometry of cilia and the parameters for the actuation should be optimized. Since the presented manufacturing approach is based on microlithography, the geometry of the cilia including the length, width, height, orientation, and spacing can be manipulated for an optimal design. Also a three-dimensional array of cilia can be fabricated by piling multiple stacks of cilia. The versatile actuation mechanism can enhance the benefit of the cilia device. The sinusoidal actuation used in this experiment can be changed to asymmetric excitation similar to that of biological cilia. The resonance frequency can be tuned for vibration of a specific array of cilia in a device. Ultimately the flow pattern can be skillfully manipulated by combining all the advantages of the proposed biomimetic cilia.

X. Conclusions

High-aspect-ratio PDMS cilia structures were fabricated by an underwater fabrication method, enabling the assembly of a highly compliant cilia array in a microfluidic device. Through the method, collapse of PDMS cilia could be avoided due to elimination of surface tension and reduction of interfacial energy when fluid was introduced. The fabricated cilia were resonated at 65 Hz in water, which is in the range of the beating frequency of biological cilia. Rotational and propulsive flows were generated by cilia motion, which was predicted by the numerical simulation and observed in the experiment. Through the optimization of the cilia device, microfluid can potentially be manipulated for various purposes in a bio-compatible manner.

Example Two

Fluid Manipulation by Biomimetic Cilia

I. Fabrication

1. Fabrication of the PDMS Cilia Structure

Two kinds of cilia array were fabricated for fluid actuation; both vertical and horizontal cilia array were fabricated according to the methods used in "Example One" above. Deep reactive ion etching (DRIE) with the standard Bosch process (ICP 380, Oxford Instruments) was used to fabricate a high aspect ratio the structure. To remove the Bosch polymers generated in DRIE, the wafer was etched by O2 plasma at 300 W power for 10 minutes (Model 2000, Branson), followed by removing the photoresist in H2O2+H2SO4 mixture (1:3) for 10 minutes. The processed wafer was rinsed in flowing de-ionized (DI) water for 15 minutes. After drying the Si mold by nitrogen gas flow, it was silanized with tridecafluoro-1,1,2,2-tetrahydroctyl-1-trichlorosilane (United Chemical Technolgies, Inc.) for 2 hours in a desiccator in order to grow the monolayer. It helped release a cured PDMS structure from the mold. The PDMS prepolymer and curing agent (Sylgard 184, Dow Corning Corp.) were thoroughly mixed at the weight ratio of 10:1. The mixture was poured over the mold. For the horizontal PDMS cilia arrays, the excessive PDMS mixture was scraped by using a piece of flat PDMS. The mold was left in a vacuum chamber for 1 hour to remove bubbles in the mixture. The PDMS mixture was cured at 70° C. for 1 hour. After the curing, the cilia structure was carefully released from the master mold.

2. Underwater Fabrication Process for High Aspect Ratio PDMS Structures

The channel device was composed of a 1 mm thick glass slide, a chamber, a supporting block, a cilia structure, and a cover. The fluidic chamber was made of a cured 2 mm thick PDMS plate, which was punched to make a 30 mm×7 mm (W×D) rectangle hole in the center. A 25 mm×4 mm×0.7 mm (W×D×H) PDMS block was prepared to support the cilia structure. The cover of the channel was 0.4 mm thick PDMS plate. The PDMS chamber and the supporting block were bonded to a glass slide by stamp-and-stick (S-A-S) room-temperature bonding technique.

Because of the low stiffness (~750 KPa), most PDMS cilia from the mold were collapsed and paired. In water, the collapsing and pairing was aggravated since the PDMS structures were hydrophobic to water. The stiction and collapse problems of the high-aspect-ratio PDMS structure usually occur, even if we use hydrophilic solutions to PDMS such as ethanol or dimethylformamide (DMF) for the separation of each cilium. To solve this collapsing problem, an underwater fabrication process was developed as follows.

After the curing and the bonding, both the cured PDMS cilia arrays on the mold and the fluidic chamber were immersed in a water bath and released in accordance with the underwater release detailed in "Example One" above. The cilia structure was successfully assembled in a fluidic channel without any collapse and paring. The horizontal PDMS cilia were viable in a solution. But, when the cilia structure was released from the mold in air, all the vertical cilia were bent and paired.

II. Experiments

1. Experimental Set-Up

The cilia array was actuated at the resonance frequency for fluid manipulation. Piezo microstage (PZS-200, Burleigh Instruments, Inc.), a signal generator (33220A, Agilent), and a high voltage amplifier (PZ-150M, Burleigh Instruments, Inc.) were used for the actuation. By controlling the signal generator, the frequency and travel distance of the piezo actuator could be controlled. The moving distance of the cilia device was set to 20 m. It was measured by an inductive sensor (SMU-9000-15N, Kaman Sensor Systems). The horizontal cilia array device was prepared as mentioned above and clamped to the actuator. The cilia movement and the flow patterns were video-recorded (Dazzle digital video creator 150, Pinnacle Systems) through a light microscope. To investigate the flow patterns, 1 L (6.6% solids in water) microspheres (PS06N/5878, mean diameter: 6.02 m, Bangs Laboratories, Inc.) were added to DI water.

2. Frequency Response of the PDMS Cilia in the Air and in the Microsphere Solution We compared the resonance frequencies of the PDMS horizontal cilia in both air and DI water. One cilia array was disposed in a fluidic channel filled with the microsphere solution. This cilia array was vibrated at a 60 Hz input frequency. The maximum relative motion of the cilia was observed at 50 Hz in the solution and at 120 Hz in air. FIG. 17B shows relative cilia tip amplitudes (ratios of tip "T" to base "B") to the frequency response of the cilia in air and in the solution. Since the relative value is the ratio of the input and output amplitudes, it is dimensionless.

3. Flow Patterns Due to the Relative Cilia Motion

Flow patterns near PDMS cilia were changed due to relative cilia motion. A device was fabricated to see the flow patterns when cilia were actuated. FIG. 18 shows the schematics of the device. An array of PDMS cilia having a dimension of 800 m×9 m×40 m (L×W×H) and 500 m spacing between cilia (S) was assembled in a rectangular shaped well. The well was filled with DI water and a small volume of the diluted microsphere solution was added to investigate the fluid patterns. The input frequency was 90 Hz and the actuation distance of the device was 20 m.

FIG. 18 shows the configuration of the fabricated device having three cilia. The 2.5 mm×4.5 mm×1 mm (W×D×H) PDMS well is on the center of the glass slide and filled with the microsphere solution. The cilia structure is on the PDMS support (2.5 mm×1 mm×0.6 mm; W×D×H). When the device was actuated at a specific frequency range, the cilia were actuated in a solution. To compare microsphere movement with cilia actuated in a solution at specific frequencies versus movement without cilia upon the same vibration input, only the cilia of the same device were removed. Other experimental conditions were the same. According to the observation of microspheres motion, a propulsion flow was generated due to the motion of the cilia.

III. Conclusions

A high aspect ratio PDMS cilia structures were fabricated by micro-fabrication methods. The newly devised underwater fabrication method enabled the assembly of the high-aspect ratio PDMS cilia structure in a fluid device. Through the method, the pairing and collapsing of the cilia was avoided due to the lowered interfacial energy.

An array of the cilia was actuated in air and a solution by a PZT microstage. The resonance frequency of the cilia in the solution was approximately a half of that in air. The fluid flow patterns in the vicinity of the each cilium were investigated and compared with the fluid patterns without the cilia structure. It was found that the relative motion of the cilia generated the convective and propulsive flow patterns.

Example Three

Cilia Device for Microfluid Manipulation

A cilia device for resonating the cilia in water was fabricated in accordance with the manufacturing methods discussed above to achieve cilia with a 10 μm width, 75 μm height, and 420 μm length with the cilia spaced apart by 200 μm. A fluoreporter biotin quantitation assay kit (Invitrogen, Carlsbad, Calif.) was used to determine the reaction performance. The mixing performance of the cilia device was evaluated by three kinds of experiments; (1) diffusion, (2) vibration without cilia and (3) cilia actuation.

The zig-zag and rotational motion of the microspheres was observed in the cilia device. This complex flow could enhance bioreaction by increasing a molecular collision rate. According to the avidin-biotin experiments, the detection sensitivity due to the cilia-actuation was enhanced by 1000 times those of the other cases, as shown in FIG. 19. Considering the versatile fabrication and actuation protocols, the proposed cilia can be used as a simple, universal micromixer of bioassays.

Example Four

Invention Description

I. Cilia Fabrication

While there is significant interest in fluid manipulation using cilia-based mechanisms, micro/nanoscale fluid manipulation using cilia actuation has not been achieved due to the difficulty in fabricating and assembling small-scale freely-suspended cilia-like structures. The present invention overcomes this problem via the biomimetic cilia-containing devices described herein. Regarding one dimensional fluid transport [FIG. 20A], an electric field guided assembly method can be used to fabricate a parallel horizontal array of cilia with desired spacing and lengths. Two dimensional fluid transport [FIG. 20B] needs vertical assembly of cilia (the cilia are vertically grown on a substrate).

2. Cilia Actuation

The cilia are actuated by using acoustic waves or electrostatic force. Acoustic waves have an advantage that cilia can be remotely controlled through a medium of a substrate or a fluid [e.g FIGS. 21A-B]. Electrostatic force will be advantageous in that cilia can be individually controlled by electric potential. As shown in FIG. 21A, suspended cilia are actuated by acoustic asymmetric pulses. And as shown in FIG. 21B, the difference between the slow stroke (forward movement) by acoustic energy and the fast stroke (backward movement) by elastic energy of the cilium generates the directional flow.

3. Applications of the Active Biomimetic Cilia (ABC):

The devices of the invention enable applications which need to: (a) control the diffusion rate of chemical reactions, (b) efficiently mix several different bio/chemical species, or (c) transport liquid in a controllable way. For example, since the proposed acoustic actuation can be used to activate specific sets of cilia, the devices can be used to develop fluidic valves, and furthermore multi-functional bio chips. Also, diffusion in a multiple phase flow can be controlled using the various lengths of cilia. Mixing can be enhanced using the devices, which will shorten the necessary time for bio/chemical reaction.

4. Enhance Portability and Bio-Compatibility of Fluidic Devices:

The proposed fluidic device eliminate the complicated, cumbersome fluid transport of current bio-fluidic devices. Moreover, the cilia propulsion will enable a convenient fluid transport in a disposable microfluidic device through remote actuation. Such use of acoustic waves to indirectly excite the devices will also lead to ideal bio-compatible actuation mechanism, since it avoids biomolecules' damage during transport.

5. Manufacturability of Bio-Fluidic Devices:

Fabrication example: FIG. 22 shows the fabrication procedure for the fluidic device. An oxide layer (500 nm) is thermally grown on Si wafer to fabricate an electric insulation layer [FIG. 22A]. The oxide layer is patterned to create a trench by a reactive ion etching (RIE) [FIG. 22A]. Cr/Au electrodes are deposited on the oxide layer for SiC cilia assembly [FIG. 22B]. SiC cilia will be aligned by an electric field guided assembly method on the electrodes [FIG. 22C]. To mechanically clamp the assembled SiC cilia, an additional metal layer (Al) will be deposited on the SiC cilia [FIG. 22D]. Since the lengths of SiC cilia are not uniform, the cilia will be patterned by several micromachining steps. Photoresist will be spin-coated and patterned on the SiC assembled device [FIG. 22E]. Through the thin slit of the photoresist, RIE will be performed to etch the center region of the SiC cilia followed by the photoresist removal. The SiC cilia will be safely suspended by a CO2-critical point drier [FIG. 22F]. The proposed fluidic device will be completed by covering the assembled device with a poly dimethylsiloxane (PDMS) mold [FIG. 22G]. The assembled device will be tested under a light microscope to observe the fluid flow velocity and direction. The DI water suspending the microspheres will be injected to the fluidic channel by a peristaltic pump.

An example configuration of an array of multiwalled carbon nanotubes (MWCNTs) were assembled across electrodes by an electric field (J. Chung, K.-H. Lee, J. Lee, and R. S. Ruoff, Toward Large Scale Integration of Carbon Nanotubes, *Langmuir* 20, 3011-3017, 2004.). Also, using a plasma enhanced chemical vapor deposition method (PECVD) can create vertically grown Si cilia (achieved by Washington Technology Center).

Example Five

Bio-mimetic Silicone Cilia Device for Biomixing

I. Objectives

II. Procedure

Task 1: Fabrication of an 8×1 Array Consisting of Well and Cilia Array

The goal of this task is to fabricate an 8×1 array device containing three cilia [FIG. 23]. An array of well and cilia devices is made of polydimethylsiloxane (PDMS). The well has 5 mm in diameter and 3 mm in height while the cilia are 800 μm in length, 80 μm in height, and 10 μm in width. The spacing of neighboring cilia is 400 μm. The optimal dimensions of the design parameters are suggested at the end of this study.

For the fabrication of the devices, the underwater fabrication process shown in FIG. 13 is utilized. The cilia released from a silicon mold in buffer solution are assembled directly to the wells in the same buffer. After releasing the device out of the buffer solution, the buffer flooded on the surface of the device is completely wiped. Subsequently, a ½ μL of the buffer solution remains in a well by removing the solution with a pipette in order to avoid collapse due to surface tension in biomixing experiment.

Task 2: Experimental Analysis of Fluid Flow Due to a Cilia Array

The goal of this task is to characterize the flow patterns generated by cilia. The cilia in a well are excited by a piezo-actuator. The piezo-actuator is purchased from Physik Instrumente. The challenge of this task is how to analyze the three dimensional flow generated by cilia.

To analyze the flow pattern in three dimensions, 15 μm-diameter spheres are used as flow markers. The motion of the spheres is monitored in several different planes by adjusting the height of an objective lens (FIG. 24A).

The images are captured by a camera capable of sampling images at 30 frames/second. In a short time span (0.1~1 second), the particle motion is analyzed by particle image velocimetry (PIV) software (mpiv in MATLAB). By using the PIV software, the horizontal flow field is computed. Based on the two dimensional images, three dimensional flow is constructed using the conservation of mass. The two-dimensional flow measured at the plane of cilia is compared with the flow from simulation.

Our preliminary study shows that the sampling rate 30 frames/second is sufficient to construct the flow fields because the shutter of the camera is fully open and refreshed every 1/30 second. FIG. 24B shows the PIV analysis performed by the mpiv software for a convective flow. The convective flow direction is clearly expressed in FIG. 24B.

Task 3: DNA Hybridization Assay

The goal of this task is to evaluate the biomixing performance of the cilia devices by using a DNA hybridization assay. Compared with the avidin-biotin assay in our preliminary result, the binding constant of DNA hybridization is $10^6$ M. Thus, the effect of the mixing can be shown dramatically because the success of single hybridization events depends upon the probability of a thermodynamic reversible process of DNA-DNA intermolecular collision.

The mixing efficiency of the assay is evaluated in terms of the assay time, the sensitivity, and the specificity. In this experiment, the effect of cilia-induced mixing is compared with the diffusion-controlled effect. The detections of DNA hybridization are performed under condition of (1) Cilia-actuated (three cilia in each well) and (2) diffusion-controlled mixing are compared.

A molecular beacon is used for this DNA hybridization study. A molecular beacon is a stem-loop oligonucleotide probe emitting fluorescent light upon hybridization with its target. A molecular beacon probe will be used in a solution phase in order to decrease errors. Molecular beacon probe-and the target oligonucleotides are custom synthesized with HPLC purification (Integrated DNA Technologies, Coralville Iowa). The microplate surface is treated with bovine serum albumin (BSA, Sigma Aldrich) to minimize nonspecific binding of DNA probes/targets onto the well surface.

Second, detection of a single nucleotide polymorphism in codon 158 of the human ApoE gene (sequence T: 5'-GCCAGGCGCTTCTGCA-3') (SEQ ID NO:1) is performed as a model analyte. The corresponding MB probe sequences are; MB 1 (noncomplementary) 5'-FAM-tgacggGAAGGTGGAATGGTTGccgtgaDABSYL-3' (SEQ ID NO:2); MB2 (perfect match) 5'-FAM-tgacggGAAGGTGGCATGGTTGccgtga-DABSYL-3' (SEQ ID NO:3). In the experiment, the non-complementary control (MB1) and the perfect match sequence (MB2) are used for the detection of the oligonuceotide target T. The sensitivity is compared for both cases (cilia-induced and diffusion-controlled mixing).

For experimental details, a 15-μL buffer solution is dropped into each well. Then 5-L solution of each probe is added (concentration 10 nM). The complementary Target T will be added with various concentrations (final concentration) ranging from 10 nM (10-8 M) to 1 aM (10-18 M=3 copies in 5 μL) by a factor of 10. For the reproducibility study, the experiments will be repeated three times. A fluorescent intensity is captured every 5 minutes for 12 hours.

The mixing efficiency is evaluated for the ratio of the fluorescent intensity of the cilia actuation to that of the diffusion. This mixing efficiency is compared to that from the modeling result (Task 4).

Task 4: Parameter Analysis and Optimization for Biomixin

This task is to model the fluid flow generated by cilia and predict parameters demonstrating efficient mixing of molecules. The simulation is performed by COMSOL Multiphysics software providing dynamic modeling of solid/fluid interaction.

In the simulation, the fluid velocity and pressure fields are computed by the Navier-Stokes equations. At a given time step, once the flow field is computed, the forces acting on the cilium are calculated to analyze the deformation of the cilium. The boundary between the solid and fluid interface is handled by the arbitrary Lagrangian-Eulerian (ALE) technique calculating the dynamics of moving boundaries and deforming geometry. In the proposed work, three cilia are positioned in a fluid domain, and their group motion is predicted by the simulation. In addition, the dimensions for cilia are changed to optimize the mixing performance of the cilia-induced mixer.

Parameters for Mixing Efficiency:

To demonstrate mixing efficiency of fluid motion, several parameters are employed. Note that several parameters quantifying mixing have recently been proposed using simulation. One parameter showing the mixing efficiency is 'length of a strip'. In this approach, a rectangular strip is formed at the initial state of simulation in the middle of fluid domain, and the mixing efficiency is quantified by tracking how the interfacial length of the strip is changed due to the fluid flow. In the simulation, the strip is described by markers (coordinates of specific fluid particles) and their trajectories are evaluated by integrating the sum of velocities using an Euler integration method. Once the trajectories are defined, the markers are interpolated to calculate the extended length of a strip. By normalizing the strip length, the mixing efficiency can be quantified.

Also the mixing efficiency according to cilia dimension, spacing, and actuation frequency can be expressed by $S_t$ (Strouhal number). $S_t$ is defined as $fL/\nu$, where f is the input vibration frequency, L is the characteristic length (e.g. spacing between neighboring cilia), and $\nu$ is the mean velocity of the fluid. This parameter is advantageous in that the effects of the fluid velocity and the driving frequency are analyzed simultaneously. By plotting the strip length according to $S_t$ in a graph, the mixing efficiency can be quantified at a glance. Especially the cilia operation at a resonance frequency is evaluated in terms of energy efficiency vs. fluid flow generation.

Preliminary Results

To generate fluid flow, the cilia immersed in water are excited by a piezo actuator. FIG. 16 presents the corresponding frequency response for the cilia in terms of the relative amplitude (T/B) of the tip displacement (T) to the base (B) of cilia in water. The tip amplitude (T) is 2.6 times that of the actuation distance of the bottom (B) at the resonance frequency (65 Hz). It has been verified that this resonance is not originated from the fluid device because the resonance frequency is shifted by changing the spacing of cilia. Without cilia, fluid flow is not generated. The trajectories showed the motion of four microspheres in the vicinity of resonating cilia. The microspheres move in the y-direction with an oscillatory and spiral motion between neighboring cilia. The wobbling motion of the flow near resonating cilia can enhance mixing performance.

The fluid flow was analyzed by a software, Comsol Multiphysics. The velocity vectors of the fluid flow due to the cilia motion were averaged for ten periods (10/65 seconds) because the flow velocity was continuously varying in an oscillatory manner due to the cilia motion. Rotational flows were generated at the tip of the each cilium while propulsive flows were formed right above the cilia. The simulation results qualitatively agreed with experimental results.

The fluid flow generated by the cilia can significantly enhance the bioreaction performance. A fluoreporter biotin quatitation assay kit (Invitrogen, Carlsbad, Calif.) was used to compare the reaction performances. This assay emits fluorescent light upon binding of avidin and biotin. Since the binding constant of avidin-biotin is very high (1015 M-1), the reaction is generated as soon as both molecules meet. Thus the product of this bioreaction directly indicates the collision rate of the biomolecules due to mixing. For this experiment, the concentrations of biotin were controlled to 0 (negative control), 0.1, 1, 10, 100, and 1000 nM. The cilia were excited by a piezo actuator for 5 minutes (90 Hz, 20 m excitation distance). For biomixing experiment, (1) diffusion and (2) cilia actuation were performed. The fluorescent image of each reaction was captured every 30 seconds through a fluorescence microscope from the injection of the biotin to the avidin solution. The experiment was repeated three times for each concentration.

FIGS. 25A-C show the experimental results. For the negative control experiment not having biotin, the relative intensity of fluorescence is decreased for both cases (FIG. 25A). The intensity decrease is ascribed to photobleaching of fluorophore. However, the decrease of the intensity is less for the cilia actuation. When the normalized intensities are compared for the various concentrations, the intensity for the cilia actuation is higher than that for the diffusion (FIG. 25B). The relative mixing efficiency of the cilia actuation to the diffusion is shown in (FIG. 25C). The relative efficiency reaches the maximum at the 100 nM concentration due to the saturation of the fluorescent intensity at 1 M. In this proposed work, the mixing efficiency will be verified and evaluated using more complex biomixing of DNA hybridization.

Example Six

Specific Aims p. 44

I. Silicone Cilium Actuator and its Actuation in Water

A high-aspect-ratio (1:80) bio-mimetic PDMS cilia was fabricated in accordance with the manufacturing methods discussed above (FIG. 13). The key issue of this fabrication is in the pairing and the stiction of the PDMS cilia array. To decrease the surface energy of the cilium structure, a novel fabrication method "under-water fabrication" was developed. All the fabrication is performed in water such that the interfacial energy can be decreased two times. The successfully fabricated PDMS cilia have dimensions of 800 μm (L)×10 μm (W)×75 μm (H). The spacing of neighboring cilia is 500 μm.

The cilia array is actuated in air and water at resonance frequencies by a piezo-actuator. The piezo microstage was used to induce the vibration input, when a silicone cilium installed in a microwell. When the cilium is actuated in water, the relative amplitude (input amplitude/output amplitude) is 5 at the resonance frequency in water. The excitation distance of the actuator was set to 20 μm. The tip displacement was amplified about 5 times at the resonance frequency of 90 Hz. This low frequency actuation is advantageous in bioreaction because it does not damage enzymes but generates a chaotic flow. Note that biological cilia are also operated in the similar frequency regime.

FIG. 26 shows normalized frequency response of the observed cilium motion based on the relative cilium tip amplitudes (ratios of T to B) to the cilium base in air and in water. The resonance frequency drops from 250 Hz in air to 100 Hz in water. The reduction of the frequency in fluid-cilium interaction can be explained by the added-mass. The inertia of the fluid (or resistance to this acceleration) exerts a resistive force on the body; this resistive force exerted by the fluid on the body is termed as the added mass effect because dynamically the body responds as if its mass has increased. This added mass of the body depends on the medium in which the body (cilia-actuator) is moving.

II. Fluid Flow Generation and its Modeling

A chaotic flow pattern near PDMS cilia is generated due to the relative cilia motion. An array of PDMS cilia was assembled in a microwell filled with water. Microspheres having 10 μm in diameter were added to the water for the flow pattern observation. The motion and directions of 4 selected microshperes near moving cilia were observed from 0 to 1 sec at 90 Hz. A convective and propulsive flow is generated due to the motion of the cilia, which displays a chaotic flow. In the proposed work, the flow field in three planes will be analyzed by the 'mpiv' module in Matlab (The Mathworks, Inc.). The experimental results are integrated with the modeling results.

COMSOL Multiphysics (Burlington, Mass.) was used to understand fluid/solid interaction and its induced flow around a moving cilium. A 2-dimensional simulation model was developed under fluid-structure interaction mode in the micro-electro-mechanical-system (MEMS) module. It consists of plain strain for structure analysis, incompressible Navier-Stokes mode for fluid, and arbitrary-Lagrangian-Eulerian (ALE) for moving boundary problem. FIG. 27A represents the geometry of the simulation model. The model contains an 800 μm×10 μm (L×W) cilium attached to a supporting block and its height is 75 μm for fluid load calculation. A 10 μm in diameter sphere is in a 5 mm×2.5 mm water chamber. The sphere is placed 100 μm from the cilium tip to see movement due to the cilium actuation. For the boundary conditions shown in FIG. 27B, the support block has displacement constraint so that the cilium has 20 μm moving distance in the x-direction with 90 Hz sinusoidal signal. When a particle is placed in the solution as shown in FIG. 27A, the particle is moving upward according to the propulsive flow due to the cilium, which agrees well with our experimental observation.

III. Enhanced Biotin-Avidin Fluorescence Assay by the Cilia Actuation

The chaotic flow generated by the cilia can significantly enhance the bioreaction performance. The experimental set-up for the bioreaction placed the PDMS cilia in a solution in the cilia device (diameter=3 mm). A fluoreporter biotin quantitation assay kit (Invitrogen, Carlsbad, Calif.) was used to compare the reaction performances, in which avidin is labeled with fluorescein to emit light upon binding with biotin. A 3.5 L reagent was dropped into the device. In addition to the reagent, 0.5 L of various biotin concentrations (negative control, 0.1, 1, 10, 100, and 1000 nM) was injected to the well through a capillary tube by a syringe pump. Then, the cilia were actuated by the piezo actuator for 5 min (90 Hz, 20 μm actuation distance). For bioreaction experiments, (1) diffusion, (2) vibration without cilia and (3) cilia actuation were performed. The image of each reaction was captured every 30 seconds through a fluorescence microscope right after the injection of the biotin.

FIG. 28 shows the experimental results for (a) diffusion, (2) vibration without cilia and (3) cilia actuation. For the negative control experiment not having biotin, the relative intensity of fluorescence was decreased for the three cases. However, the least decrease of the intensity was observed for the cilia actuation. The intensity decrease was ascribed to photobleaching of fluorophore. In the cilia actuation, the chaotic stream generates convective flows, which reduce the photobleaching (more frequent collision with water and dye molecules). The low Young's modulus cilia provided less damage but more effective flow circulation.

When the biotin concentration was 1 μM, a positive intensity was observed for diffusion and cilia actuation, but a higher intensity was measured for the cilia actuation. When the concentration was decreased to 100, 10, and 1 nM, the light intensity of the cilia actuation showed a positive value, but the intensities for the vibration and diffusion showed a negative value.

FIG. 29 shows the relative intensity variation according to various concentrations for the cilia actuation experiment. As the concentration increases, the relative intensity increases. Considering the experimental results, the sensitivity of the tested bioassay kit is enhanced by three orders of magnitude by using the cilia actuation.

SEQUENCE LISTING

```
<160> NUMBER OF SEQ ID NOS: 3

<210> SEQ ID NO 1
<211> LENGTH: 16
<212> TYPE: DNA
<213> ORGANISM: Artificial Sequence
<220> FEATURE:
<223> OTHER INFORMATION: Synthetic

<400> SEQUENCE: 1

gccaggcgct tctgca                                                    16


<210> SEQ ID NO 2
```

-continued

```
<211> LENGTH: 28
<212> TYPE: DNA
<213> ORGANISM: Artificial Sequence
<220> FEATURE:
<223> OTHER INFORMATION: Synthetic
<220> FEATURE:
<221> NAME/KEY: misc_feature
<222> LOCATION: (1)..(1)
<223> OTHER INFORMATION: 5'-FAM
<220> FEATURE:
<221> NAME/KEY: misc_feature
<222> LOCATION: (30)..(30)
<223> OTHER INFORMATION: DABSYL-3'

<400> SEQUENCE: 2

tgacgggaag gtggaatggt tgccgtga                                        28


<210> SEQ ID NO 3
<211> LENGTH: 28
<212> TYPE: DNA
<213> ORGANISM: Artificial Sequence
<220> FEATURE:
<223> OTHER INFORMATION: Synthetic
<220> FEATURE:
<221> NAME/KEY: misc_feature
<222> LOCATION: (1)..(1)
<223> OTHER INFORMATION: 5'-FAM
<220> FEATURE:
<221> NAME/KEY: misc_feature
<222> LOCATION: (30)..(30)
<223> OTHER INFORMATION: DABSYL-3'

<400> SEQUENCE: 3

tgacgggaag gtggcatggt tgccgtga                                        28
```

The invention claimed is:

1. A device, comprising:

a plurality of cantilevered silicone-polymer cilia attached to a common silicone-polymer backbone that comprises a plate defining a plurality of openings, wherein a plurality of the cantilevered silicone-polymer cilia are disposed in each opening, wherein each silicone-polymer cilium has a length that is at least 5 times greater than its width, and wherein a length of each silicone-polymer cilium is between about 100 nm and about 10 mm;

a liquid disposed among the plurality of silicone-polymer cilia, wherein individual silicone-polymer cilia are at least partially submerged in the liquid;

wherein the silicone-polymer cilia are arranged for excitation into resonance, and wherein the device does not include an attached actuator.

2. The device of claim 1, wherein the plurality of silicone-polymer cilia are further arranged for mixing the liquid.

3. The device of claim 1, wherein the plurality of silicone-polymer cilia are further arranged for mixing, at least, a fluid in communication with the liquid.

4. The device of claim 3, wherein the fluid includes a liquid or a gas.

5. The device of claim 1, wherein the backbone has a depth such that the plurality of openings form wells.

6. The device of claim 5, wherein the backbone is mated with an additional layer to either add depth to create the wells or to form a closed fluid channel.

7. The device of claim 6, wherein the backbone is mated with an additional layer to form a closed fluid channel, wherein the additional layer defines cavities above the openings.

8. The device of claim 1, wherein the plurality of silicone-polymer cilia are further arranged for inducing a reaction between at least one species with at least one other species such that the reaction rate of the reaction is greater than a diffusion limited reaction between the species and the other species.

9. The device of claim 1, wherein a spacing between individual cilia of the plurality of silicone-polymer cilia is configured for mixing.

10. The device of claim 9, wherein the spacing is greater than about half of an average length of the plurality of silicone-polymer cilia.

11. The device of claim 1, wherein the silicone-polymer cilia are further arranged for pumping the liquid and/or another fluid in communication with the liquid.

12. The device of claim 11, wherein the fluid is a liquid.

13. The device of claim 11, wherein the fluid is a gas.

14. The device of claim 11, wherein the fluid is configured for heat transfer.

15. The device of claim 1, wherein a spacing between individual cilia of the plurality of silicone-polymer cilia is configured for pumping.

16. The device of claim 15, wherein the spacing is less than about half of an average length of the plurality of silicone-polymer cilia.

17. The device of claim 1, wherein individual cilia of the plurality of silicone-polymer cilia are arranged to provide a reactive transfer of momentum at a location of attachment.

18. The device of claim 1, wherein the plurality of cantilevered silicone-polymer cilia and the silicone-polymer backbone comprise polydimethylsiloxane.

19. A microfluidic apparatus comprising one or more devices according to claim 1, wherein the plurality of silicone-polymer cilia are disposed in at least one fluid channel having a cross-sectional dimension of less than 1000 μm.

* * * * *